US006655882B2

(12) United States Patent
Heinrich et al.

(10) Patent No.: US 6,655,882 B2
(45) Date of Patent: Dec. 2, 2003

(54) TWIST DRILL HAVING A SINTERED CEMENTED CARBIDE BODY, AND LIKE TOOLS, AND USE THEREOF

(75) Inventors: Hans-Wilm Heinrich, Bayreuth (DE); Manfred Wolf, Eckersdorf (DE); Dieter Schmidt, Bayreuth (DE)

(73) Assignee: Kennametal Inc., Latrobe, PA (US)

( * ) Notice: Subject to any disclaimer, the term of this patent is extended or adjusted under 35 U.S.C. 154(b) by 114 days.

(21) Appl. No.: 09/935,078

(22) Filed: Aug. 22, 2001

(65) Prior Publication Data

US 2002/0029910 A1 Mar. 14, 2002

Related U.S. Application Data

(63) Continuation-in-part of application No. PCT/IB00/00157, filed on Feb. 14, 2000.

(30) Foreign Application Priority Data

Feb. 23, 1999 (DE) ..... 199 07 749

(51) Int. Cl.[7] ..... B23B 51/02

(52) U.S. Cl. ..... 408/144; 407/119; 408/230; 428/547

(58) Field of Search ..... 408/144, 230; 407/118, 119; 428/547, 560–562

(56) References Cited

U.S. PATENT DOCUMENTS

| | | | | |
|---|---|---|---|---|
| 4,108,260 A | | 8/1978 | Bozarth | |
| 4,830,930 A | * | 5/1989 | Taniguchi et al. | 428/547 |
| RE34,180 E | | 2/1993 | Nemeth, deceased et al. | |
| 5,219,209 A | | 6/1993 | Prizzi et al. | |
| 5,250,367 A | | 10/1993 | Santhanam et al. | |
| 5,364,209 A | | 11/1994 | Santhanam et al. | |
| 5,577,424 A | * | 11/1996 | Isobe et al. | 75/236 |
| 5,788,427 A | | 8/1998 | Zitzlaff et al. | |

(List continued on next page.)

FOREIGN PATENT DOCUMENTS

| | | |
|---|---|---|
| DE | 3211047 | 2/1988 |
| EP | 0247985 | 12/1987 |
| EP | 0603143 | 6/1994 |
| EP | 0629713 | 12/1994 |
| WO | 9317140 | 9/1993 |
| WO | 9620058 | 7/1996 |
| WO | 9910549 | 3/1999 |
| WO | 9910550 | 3/1999 |
| WO | 9910551 | 3/1999 |
| WO | 9910552 | 3/1999 |
| WO | 9910553 | 3/1999 |

OTHER PUBLICATIONS

9., erweiterte und neu– Bearbeitete Auflage Herausgeber Prof. Dr. Jürgen Falbe Düsselfdorf und Prof. Dr. Manfred Regitz Kaiserlautern Bearbeitt von zahireichen Fachkoüegen Zentralredaktion: Dr. Elisabeth Hillen–Maske.

Database WPI Section Ch, Week 199907 Derwent Publication Ltd./, London, GB; AN 1999–081741 XP002137031.

B Uhrenius et al: "On the composition of Fe–Ni–Co–WC–based cemented carbides" International Journal of Refractory Metals and Hard Materials, GB, Elsevier Publishers, Barking, vol. 15, Jan. 1, 1997, pp. 139–149, XP002085833 ISSN: 0263–4368.

*Primary Examiner*—Steven C. Bishop
(74) *Attorney, Agent, or Firm*—Nils H. Ljungman & Associates

(57) ABSTRACT

There is now provided a twist drill having an elongate body at a first end, a shank at a second and opposite end, the elongate body and the shank sharing a common axis, at least one face on the elongate body at an end opposite the shank, wherein the at least one face defines a corresponding flute extending along the elongate body toward the shank, at least one flank on an end of the elongate body at an end opposite the shank, and a cutting edge at a juncture of the at least one face and the at least one flank, and the like tools, having a sintered cemented carbide body, and the use thereof in material removing and dislodging tools.

23 Claims, 13 Drawing Sheets

U.S. PATENT DOCUMENTS

| | | | |
|---|---|---|---|
| 5,967,706 | A | 10/1999 | Hughes, Jr. |
| 5,992,546 | A | 11/1999 | Heinrich et al. |
| 5,996,714 | A | 12/1999 | Massa et al. |
| 6,010,283 | A | 1/2000 | Henrich et al. |
| 6,022,175 | A | 2/2000 | Heinrich et al. |
| 6,063,707 | A | 5/2000 | Atwater et al. |
| 6,109,377 | A | 8/2000 | Massa et al. |
| 6,145,606 | A | 11/2000 | Haga |
| 6,170,917 | B1 | 1/2001 | Heinrich et al. |
| 6,211,082 | B1 | 4/2001 | Yoo et al. |
| 6,235,644 | B1 | 5/2001 | Chou |
| 6,254,933 | B1 | 7/2001 | Habuka et al. |
| 6,260,638 | B1 | 7/2001 | Massa et al. |

* cited by examiner

TWIST DRILL HAVING A SINTERED CEMENTED CARBIDE BODY, AND LIKE TOOLS, AND USE THEREOF

CONTINUING APPLICATION DATA

This application is a Continuation-In-Part application of International Patent Application No. PCT/IB00/00157, filed on Feb. 14, 2000, which claims priority from Federal Republic of Germany Patent Application No. 199 07 749.5, filed on Feb. 23, 1999. International Application PCT/IB00/00157 was pending as of the filing date of this application. The United States was an elected state in International Application No. PCT/IB00/00157.

BACKGROUND OF THE INVENTION

1. Field of the Invention

The invention relates to a twist drill having a sintered cemented carbide body, and like tools, and the use thereof.

2. Background Information

A twist drill, and the like tools, having sintered cemented carbide bodies (cermets) of this type are described in International Patent Applications published as WO 99/10549, WO 99/10550, WO 99/10551, WO 99/10552 and WO 99/10553 of the Assignee herein. The aforementioned International Patent Applications furthermore describe the use of these sintered cemented carbide bodies as cutting inserts and cutting bits and for manufacturing drills and cemented carbide tools and tool inserts of all kinds. The entire content of said international patent applications hereby is expressly incorporated herein by reference.

Thus, there is further known from U.S. Pat. No. 5,992,546 issued to Heinrich et al. on Nov. 30, 1999, corresponding to International Patent Application No. WO 99/10552, an elongate rotary tool for machining materials, the rotary tool comprising an elongate body at a first end, a shank at a second and opposite end, the elongate body and the shank sharing a common axis, at least one face on the elongate body at an end opposite the shank, wherein the at least one face defines a corresponding flute extending along the elongate body toward the shank, at least one flank on an end of the elongate body at an end opposite the shank, and a cutting edge at a juncture of the at least one face and the at least one flank, wherein the at least one flank, the at least one face, and the cutting edge at the juncture thereof of the elongate rotary tool comprise a cermet comprising at least one hard component and a binder.

There is also known from U.S. Pat. No. 6,010,283 issued to Heinrich et al. on Jan. 4, 2000, corresponding to International Patent Application No. WO 99/10553, a cutting tool for chip forming machining of workpiece materials, the cutting tool comprising a rake face over which chips formed during the chip forming machining of workpiece materials flow, a flank face, and a cutting edge, for cutting into the workpiece materials to form the chips, formed at a junction of the rake face and the flank face, wherein at least the rake face, the flank face and the cutting edge of the cutting tool comprise a cermet comprising at least one hard component and a binder.

U.S. Pat. No. 6,022,175 issued to Heinrich et al. on Feb. 8, 2000, which corresponds to International Patent Application No. WO 99/10550, refers to a rotary tool comprising an elongate tool body having an axially forward end and an axially rearward end, a hard insert affixed to the tool body at the axially forward end thereof, and the hard insert comprising a WC-cermet comprising tungsten carbide and a binder.

There is also known from U.S. Pat. No. 6,170,917 issued to Heinrich et al. on Jan. 9, 2001, corresponding to International Patent Application No. WO 99/99/10551, a pick-style tool comprising an elongate tool body having an axially forward end and an axially rearward end, a hard insert affixed to the tool body at the axially forward end thereof, and the hard insert comprising a cermet comprising tungsten carbide and a binder.

There is also known from U.S. Pat. No. 5,788,427 issued to Zitzlaff et al. on Aug. 4, 1998, an indexable insert having two parallel cutting edges on opposite sides of an indexable insert body in the form of a rectangular block. In the intermediately placed top surface descending toward the center line thereof, there is a chipbreaking structure comprising alternating projections and recesses. These projections and recesses constitute a row, centered on the center line, of spherical-like chipbreaking bodies, between which concave chip guiding surfaces are formed. During metal-cutting operations, this provides an even flow of chips with the formation of short chips which are free of grooves and tears along the edges.

Further, there is known from U.S. Pat. No. 5,967,706 issued to Hughes, Jr. on Oct. 19, 1999, a high speed milling cutter using a wedge to secure an insert within a pocket of the milling cutter wherein the wedge is tapered in both the axial direction and the radial direction. A screw urges the wedge within a tapered cavity to press the insert within the pocket along the axial wedge angle while rotation of the cutter creates centrifugal forces urging the wedge radially outward, thereby forcing the wedge against the radial wedge surface to further compress the insert within the pocket. The insert pocket may be extended to radially encompass the insert, thereby providing additional support against centrifugal forces for the insert.

There is also known from U.S. Pat. No. 6,145,606 issued to Haga on Nov. 14, 2000, a cutting insert which comprises a pair of top surfaces which intersect to form a chisel edge, and a pair of concave surfaces wherein each one of the concave surfaces is adjacent to and intersects its corresponding one of the top surfaces. The cutting insert further includes a pair of end surfaces and a pair of arcuate surfaces. One of the arcuate surfaces intersects the one top surface and further intersects the one end surface whereby the one arcuate surface joins the one top surface and the one end surface. The other of the arcuate surfaces intersects the other top surface and further intersects the other end surface whereby the other arcuate surface joins the other top surface and the other end surface.

It is known from German Patent No. 32 11 047 and from its corresponding U.S. Pat. No. 34,180 that in the case of cemented carbides comprising a binder consisting of cobalt, nickel or iron, under certain sintering conditions and after the addition of specific additives to the hard component powder blends, a binder enriched layer which however is at the same time depleted in or free of solid solution carbides will form near the surfaces of the sintered cemented carbide bodies, while a binder depleted layer which however is at the same time enriched in solid solution carbides will form beneath the enriched layer.

As used herein, the term "cermet" refers to those materials, only, which comprise at least one metallic phase and at least one ceramic phase such as tungsten carbide (WC). Diamond and graphite per se are not considered to be "ceramic" in the language of the present application. Thus, materials comprising diamond or graphite embedded in a metal matrix or bonded with a metal alloy do not form a "cermet" in the sense of the present invention.

It is the object of the present invention to provide a novel twist drill, and the like tools, having sintered cemented carbide bodies which comprise a binder consisting of cobalt, nickel and iron, but which, compared with presently available cermets having a binder comprising cobalt, nickel, and iron, exhibit improved mechanical properties, in particular an enhanced fatigue resistance and at the same time an enhanced toughness.

The invention teaches that this object can be achieved by a twist drill, comprising: a tip portion; a flute portion disposed adjacent to said tip portion; a central longitudinal axis; said tip portion being substantially cone shaped; said tip portion having a base portion and a top portion; said base portion being substantially wider than said top portion; said base portion being disposed immediately adjacent to said flute portion of said drill; said top portion being disposed on said tip portion opposite to said base portion; said tip portion comprising: a first chip face forming a portion of said conical surface of said tip portion; a second chip face forming a portion of said conical surface of said tip portion; a chisel edge arrangement configured to initiate drilling a material to be drilled; said chisel edge arrangement being disposed between said first chip face and said second chip face; said first chip face having a first end disposed adjacent to said chisel edge arrangement and a second end disposed opposite to said first end and adjacent to said body portion of said drill; said second chip face having a first end disposed adjacent to said chisel edge arrangement and a second end disposed opposite to said first end and adjacent to said body portion of said drill; said first chip face being configured to extend monotonically away from said flute portion to said chisel edge arrangement disposed on said top of said tip portion; said second chip face being configured to extend monotonically away from said flute portion to said chisel edge arrangement disposed on said top of said tip portion; said first chip face being disposed to meet said second chip face at said top of said tip portion; and said chisel edge arrangement comprising: a first chisel edge portion; a second chisel edge portion; each of said chisel edge portions being disposed to extend away from each other from said central longitudinal axis; wherein: at least a portion of said tip portion and at least a portion of said flute portion comprise a tool portion having an interior and an exterior; said tool portion comprising: a cermet body comprising at least one hard component and a binder, said binder comprising: in the range of from about forty weight percent to about ninety weight percent of cobalt; in the range of from about four weight percent to about thirty-six weight percent of nickel; in the range of from about four weight percent to about thirty-six weight percent of iron; and a ratio of nickel to iron in the range of from about one point five to one, to from about one to one point five; said binder in said body having a first concentration at a first portion and a second concentration at a second portion; said first concentration in said first portion being substantially different from said second concentration in said second portion to thus form a gradient in said body; said binder comprising a substantially face centered cubic structure; with the difference in concentration between said first concentration and said second concentration of said binder in said body being configured and disposed to substantially maintain said face centered cubic structure of said binder upon said binder being subjected to plastic deformation; and the difference in concentration between said first concentration and said second concentration of said binder in said body also being configured and disposed to minimize stress and strain induced transformations in said binder; and to maximize fatigue resistance and toughness in said body; and said flute portion comprising: a first chip flute; a second chip flute; and said first chip flute and said second chip flute being symmetric with respect to one another and substantially helically disposed about said central longitudinal axis; a first cutting edge, configured to drill, being disposed between said tip portion and said flute portion; a second cutting edge, configured to drill, being disposed between said tip portion and said flute portion; said first cutting edge and said second cutting edge being substantially symmetric with respect to one another about said central longitudinal axis; said first chip flute being disposed to extend helically along said flute portion from said first cutting edge; said second chip flute being disposed to extend helically along said flute portion from said second cutting edge; and said flute portion of said twist drill further comprising a shank portion configured of sufficient longitudinal extent to be positively secured in a chucking arrangement for a drill.

This object is also achieved in accordance with the invention in a sintered cemented carbide body of the initially defined species in that the concentration of the binder comprising cobalt, nickel, and iron has a gradient within the cemented carbide body and that the binder comprising cobalt, nickel, and iron has a face centered cubic structure and does not experience phase transformations induced by tension, strain or other stresses.

The concentration of the binder comprising nickel, cobalt, and iron preferably has a gradient which increases from the interior of the cemented carbide body toward the surfaces thereof. This gradient material, that is, in other words, the presence of a first concentration at a first portion and a second concentration at a second portion of the cermet, or gradient behavior of the binder comprising cobalt, nickel, and iron, is surprising to a person of ordinary skill in the art because it was unexpected that the three-component binder consisting of cobalt, nickel and iron, which preferably is present in the form of an alloy but does not necessarily have to be present as an alloy, would display a behavior similar to that of the cobalt binder frequently used in the past. Above all, it could not be expected that a distribution of the binder in the sintered cemented carbide as described above would result.

It is particularly advantageous if the binder comprising cobalt, nickel, and iron binder is enriched in a zone ("binder enriched zone", BEZ) near the surface of the cemented carbide body.

The binder enriched zone (BEZ) is preferably located at a depth of up to forty micrometers ($\mu$m) as measured from the surface of the cemented carbide body.

In a preferred embodiment of the sintered cemented carbide body in accordance with the invention, the ratio of the constituents of the binder among each other, that is, cobalt-to-nickel-to-iron (Co:Ni:Fe), is the same within the enriched zone (BEZ) in the binder as that outside of the enriched zone (BEZ) in the binder. In this embodiment the diffusion of the binder into the enriched zone proceeds in a congruent manner, i.e. without a change in the composition of the binder. This, too, was surprising to a person of ordinary skill in the art because in complicated multi-component systems an incongruent behavior of the constituents of the binder alloy is the rule more often than not.

The binder comprising cobalt, nickel, and iron of the sintered cemented carbide body in accordance with the invention has a face centered cubic (fcc) structure and does not experience phase transformations induced by tension, strain or other stresses. The binder comprising cobalt, nickel, and iron is substantially austenitic.

Preferably, the proportion of the binder in the sintered cemented carbide amounts to four to ten weight percent.

The at least one hard component is preferably selected from the carbides, nitrides, carbonitrides, their mixtures, and their solid solutions, in any desired combination. Especially preferred hard components are the carbides of titanium, zirconium, hafnium, vanadium, niobium, tantalum, chromium, molybdenum, and tungsten, as well as mixtures of a plurality of these carbides. Of the carbonitrides, those of titanium, zirconium, hafnium, vanadium, niobium, tantalum, chromium, molybdenum, and tungsten, as well as their mixtures are preferred as hard components.

The sintered cemented carbide bodies in accordance with the invention are preferably used as cutting inserts, indexable inserts and for the production of cemented carbide tools and tool inserts of all kinds.

The above-discussed embodiments of the present invention will be described further hereinbelow. When the word "invention" is used in this specification, the word "invention" includes "inventions", that is the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention will now be explained in greater detail with reference to examples in conjunction with the drawings.

DETAILED DESCRIPTION OF THE PREFERRED EMBODIMENT

Figure 1:
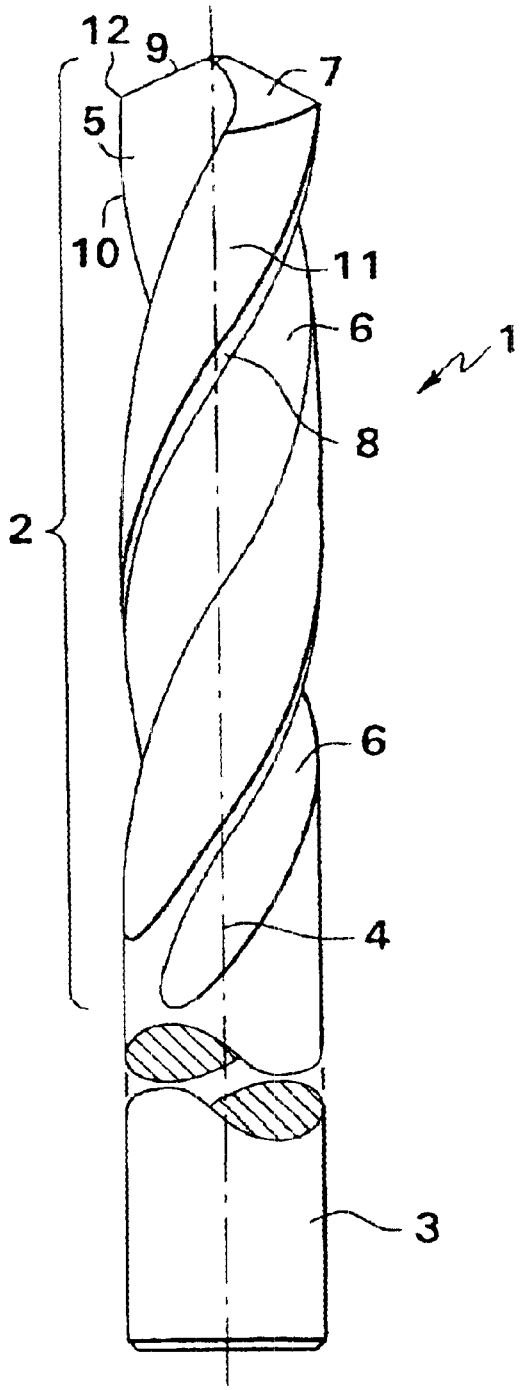
FIG. 1: is a side view of a drill, a particular embodiment of an elongate rotary tool.

As shown in FIG. 1, when the elongate rotary tool comprises a drill 1, it has at one end an elongate body 2 and at a second end a shank 3. The elongate body 2 and the shank 3 share a common axis 4. The shank 3 is adapted to be secured, e.g., in a chuck, in a machine tool. The elongate body 2 has a face 5 over which chips, formed during drilling of workpiece materials, flow. The face 5 may define or transition into a groove or flute 6 for transporting chips away from the cut surface of the workpiece material. Joined to the face 5 are first flank 7 and second flank 8. At the juncture of the face 5 and the first flank 7 is a first cutting edge 9 for cutting into workpiece materials. At the juncture of the face 5 and the second flank 8 is a second cutting edge 10 also for cutting into workpiece materials. Second flank 8 optionally may be followed by a recessed surface 11. The first cutting edge 9 transitions to the second cutting edge 10 at a corner 12. The second cutting edge 10 may take the form of a helix and continue for a preselected distance along the length of the elongate body 2. In the case of a drill, first cutting edge 9 performs a majority of the cutting into the workpiece materials.

Thus, FIG. 1, a side view, of an elongate rotary tool illustrates one embodiment of an elongate rotary tool, such as a drill, including at least one cutting edge that is useful in the machining of workpiece materials. The elongate rotary tool comprises a cermet comprising at least one hard component and a binder comprising cobalt, nickel, and iron. The binder comprising cobalt, nickel, and iron is unique in that even when subjected to plastic deformation, the binder substantially maintains its face centered cubic (fcc) crystal structure and avoids stress and/or strain induced transformations.

Furthermore, in one possible embodiment of the present invention, illustrated in FIG. 1, the present invention is shown as an elongate rotary tool including at least one cutting edge that is useful in the machining of workpiece materials. The elongate rotary tool comprises a cermet comprising at least one hard component and about 4 weight percent to 10 weight percent binder comprising cobalt, nickel, and iron. The binder comprising cobalt, nickel, and iron is unique in that even when subjected to plastic deformation, the binder substantially maintains its face centered cubic (fcc) crystal structure and avoids stress and/or strain induced transformations.

FIG. 1 is a copy of FIG. 1 from U.S. Pat. No. 6,022,175 issued to Heinrich et al. on Feb. 8, 2000, having the title, "Elongate rotary tool comprising a cermet having a Co—Ni—Fe binder," from which figure copy all of the reference numerals present in the original figure, as it appears in U.S. Pat. No. 6,022,175, have been removed. U.S. Pat. No. 6,022,175 is hereby incorporated by reference as if set forth in its entirety. The reference numerals that have been removed from the figure for this U.S. Pat. No. 6,022,175, essentially reproduced herein as FIG. 1, indicate arrangements that are well known in the prior art.

Figure 2:
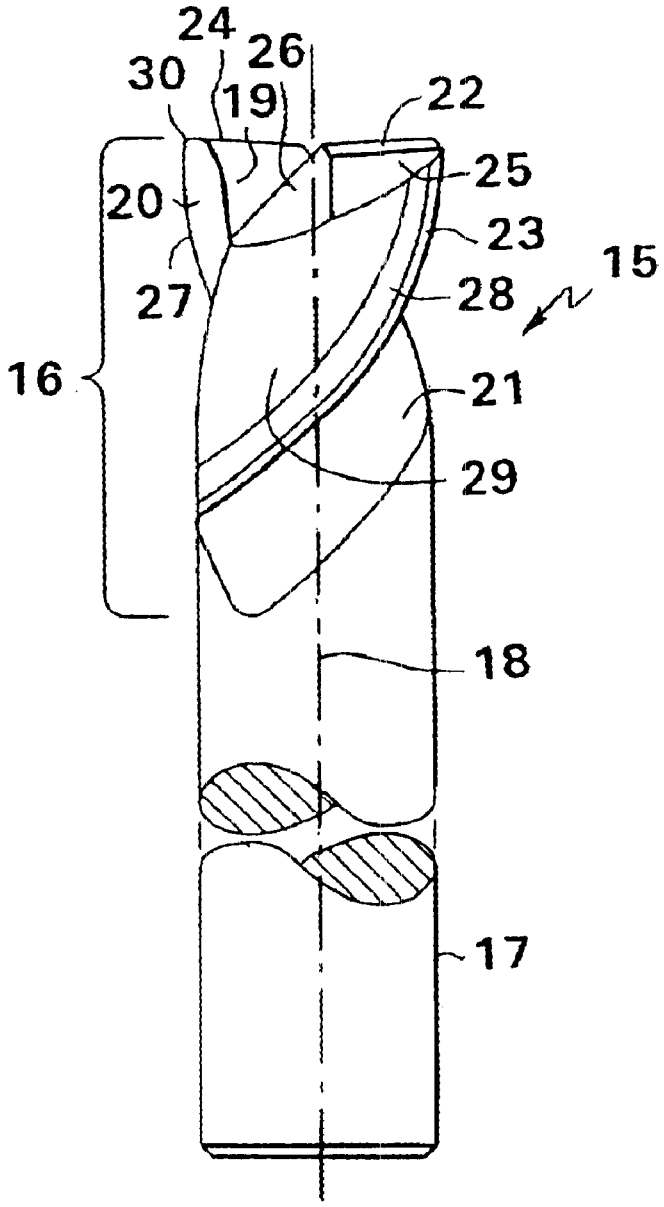
FIG. 2: is a side view of an endmill, a particular embodiment of an elongate rotary tool.

As shown in FIG. 2, a side view of an endmill, a particular embodiment of an elongate rotary tool, when the elongate rotary tool comprises an endmill 15, it has at one end an elongate body 16 and at a second end a shank 17. The elongate body 16 and the shank 17 share a common axis 18. The shank 17 is adapted to be secured, e.g., in a chuck, in a machine tool. The elongate body 16 has a face 19 over which chips, formed during milling of workpiece materials, flow. The face 19 may define or transition into a groove or flute 20 and 21 for transporting chips away from the cut surface of workpiece materials. Joined to the face 19 are first flank 22 and second flank 23. At the juncture of the face 19 and the first flank 22 is a first cutting edge 24 for cutting into workpiece materials. First flank 22 optionally may be followed by additional recessed surfaces 25 and 26. At the juncture of the face 19 and/or the groove or flute 20 and the second flank 23 is a second cutting edge 27 also for cutting into workpiece materials. Second flank 23 optionally may be followed by recessed surfaces 28 and 29. The first cutting edge 24 transitions to the second cutting edge 27 at a corner 30. The second cutting edge 27 may take the form of a helix and continue for a preselected distance along the length of the elongate body 16. In the case of an endmill 15, either the first cutting edge 24 and/or the second cutting edge 27 may perform a majority of the cutting into workpiece materials.

As such, FIG. 2 is a copy of FIG. 2 from U.S. Pat. No. 6,022,175 issued to Heinrich et al. on Feb. 8, 2000, as mentioned above, from which figure copy all of the reference numerals present in the original figure, as it appears in U.S. Pat. No. 6,022,175, have been removed. The reference numerals that have been removed from the figure for this U.S. Pat. No. 6,022,175, essentially reproduced herein as FIG. 2, indicate arrangements that are well known in the prior art.

The elongate rotary tools just described may be any of the style or sizes of drills, endmills, taps, burs, countersinks, hobs, and reamers used in the industry. For example, if the elongate rotary tool comprises a drill, it may be made in standard shapes and sizes, for example, two-fluted style of drill without or with coolant channels. The typical types of workpiece materials that a two-fluted coolant channel style of drill cuts includes carbon, alloy and cast steel, high alloy steel, malleable cast iron, gray cast iron, nodular iron, yellow brass and copper alloys.

It should also be appreciated that various styles of drills and endmills are within the scope of this invention. In this regard, other styles of drills include without limitation a triple fluted style of drill and a two-fluted style of drill that does or does not have coolant channels. The triple fluted style of drill typically cuts gray cast iron, nodular iron, titanium and its alloys, copper alloys, magnesium alloys, wrought aluminum alloys, aluminum alloys with greater than 10 weight percent silicon, and aluminum alloys with less than 10 weight percent silicon. The two fluted without coolant channels style of drill typically cuts carbon steel, alloy and cast steel, high alloy steel, malleable cast iron, gray cast iron, nodular iron, yellow brass and copper alloys. In addition to the metallic materials mentioned above, the drills, end mills, hobs, and reamers may be used to cut other metallic materials, polymeric materials, and ceramic materials including without limitation combinations thereof, for example, laminates, macrocomposites and the like, and composites thereof such as, for example, metal-matrix composites, polymer-matrix composites, and ceramic-matrix composites.

Figure 3:
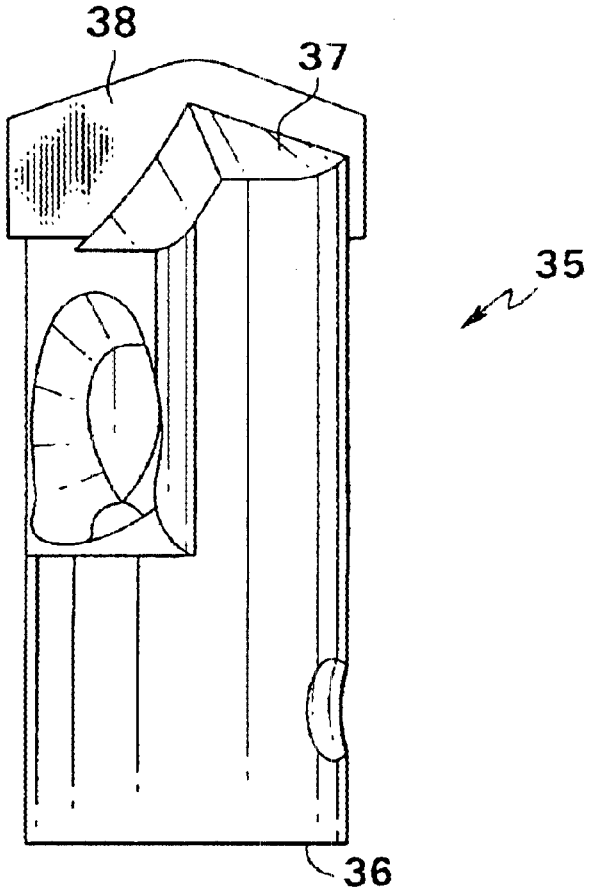
FIG. 3: is a side view of a roof drill bit of the style KCV4-1RR (Roof Rocket) made by KENNAMETAL INC. of Latrobe, Pa.

Turning now to FIG. 3, this is a copy of FIG. 1 from U.S. Pat. No. 5,992,546 issued to Heinrich et al. on Nov. 30, 1999, having the title, "Rotary earth strata penetrating tool with a cermet insert having a Co—Ni—Fe binder," from which figure copy all of the reference numerals present in the original figure, as it appears in U.S. Pat. No. 5,992,546, have been removed. U.S. Pat. No. 5,992,546 is hereby incorporated by reference as if set forth in its entirety. The reference numerals that have been removed from the figure for this U.S. Pat. No. 5,992,546, essentially reproduced herein as FIG. 3, indicate arrangements that are well known in the prior art.

FIG. 3, a side view of a roof drill bit of the style KCV4-1RR (Roof Rocket) made by KENNAMETAL INC. of Latrobe, Pa., illustrates a rotary tool that includes an elongate tool body and a hard insert affixed to the tool body. The hard insert possibly includes a cermet including tungsten carbide and a binder comprising cobalt, nickel, and iron. The binder comprising cobalt, nickel, and iron is unique in that even when subjected to plastic deformation, the binder substantially maintains its face centered cubic (fcc) crystal structure and avoids stress and/or strain induced transformations.

Referring more particularly to FIG. 3, there is illustrated a roof drill bit, generally designated as 35, of the style KCV4-1RR (Roof Rocket) made and sold by KENNAMETAL INC. of Latrobe, Pa. 15650, the assignee of the present patent application. Roof drill bit 35 has an elongate body with an axially rearward end 36 and an axially forward end 37. A hard insert 38 is affixed to the elongate body 36 at the axially forward end 37 thereof. In addition to the style illustrated in FIG. 3, Applicants contemplate that the roof drill bits which may use cutting inserts of the compositions set forth herein include the roof drill bit shown and described in U.S. Pat. No. 5,996,714 issued to Massa et al. on Dec. 7, 1999 and entitled, "Rotatable cutting bit assembly with wedge-lock retention assembly," and U.S. Pat. No. 6,260,638 issued to Massa et al. on Jul. 17, 2001 and entitled, "Rotatable cutting bit assembly with wedge-lock retention assembly,"; and the roof drill bit shown and described in U.S. Pat. No. 6,109,377 issued to Massa et al. on Aug. 29, 2000 and entitled, "Rotatable cutting bit assembly with cutting inserts," all of these three aforementioned patents are hereby incorporated by reference as if set forth in their entirety herein.

Referring to the hard insert 38 of the roof drill bit 35, the composition of the hard insert 38 comprises a binder comprising cobalt, nickel, and iron and tungsten carbide (WC). The range of the binder comprising cobalt, nickel, and iron in the WC-cermet comprises about 4 weight percent to about 10 weight percent.

Figure 4:
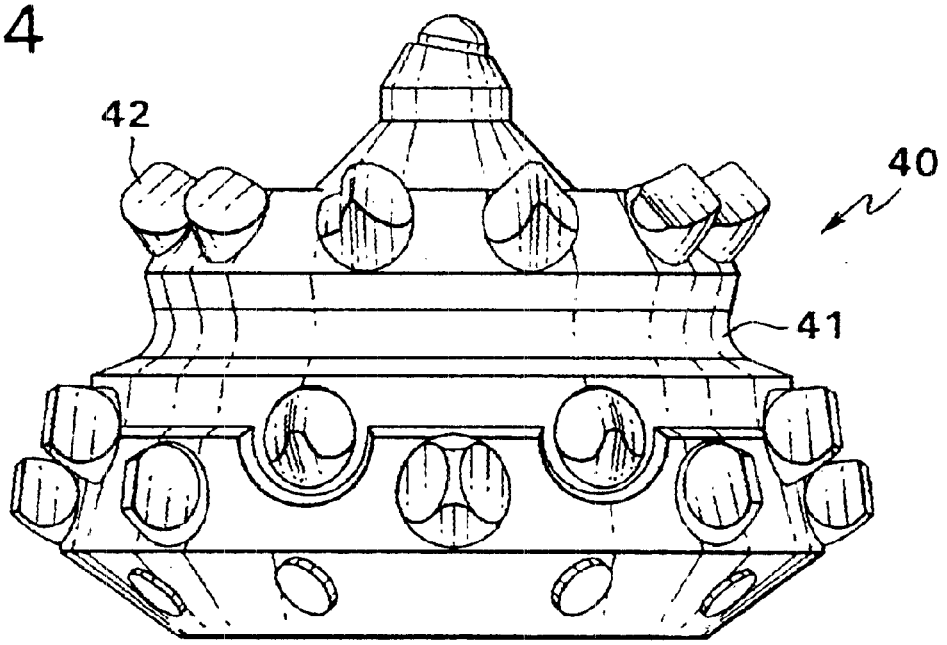
FIG. 4: is a side view of a drill bit used for downhole drilling.

Referring to FIG. 4, which is a copy of FIG. 2 from U.S. Pat. No. 5,992,546 issued to Heinrich et al. on Nov. 30, 1999, having the title, "Rotary earth strata penetrating tool with a cermet insert having a Co—Ni—Fe binder," from which figure copy all of the reference numerals present in the original figure, as it appears in U.S. Pat. No. 5,992,546, have been removed. U.S. Pat. No. 5,992,546 is hereby incorporated by reference as if set forth in its entirety, as mentioned above. The reference numerals that have been removed from the figure for this U.S. Pat. No. 5,992,546, essentially reproduced herein as FIG. 4, indicate arrangements that are well known in the prior art.

Thus, FIG. 4, a side view of a drill bit, illustrates the drill bit, generally designated as 40, for downhole drilling such as is shown in U.S. Pat. No. 4,108,260, entitled, "Rock bit for a rock bit with specially shaped inserts," to Bozarth. U.S. Pat. No. 4,108,260 is hereby incorporated by reference as if set forth in its entirety herein. Drill bit 40 has a drill bit body 41 which receives a plurality of hard inserts 42, which are made from the same WC-cermet having a binder comprising cobalt, nickel, and iron from which hard insert 38 (FIG. 3) is made. Thus, a description of a WC-cermet in conjunction with hard insert 38 (FIG. 3) will suffice for the description of the WC-cermet for hard insert 42.

Figure 5:
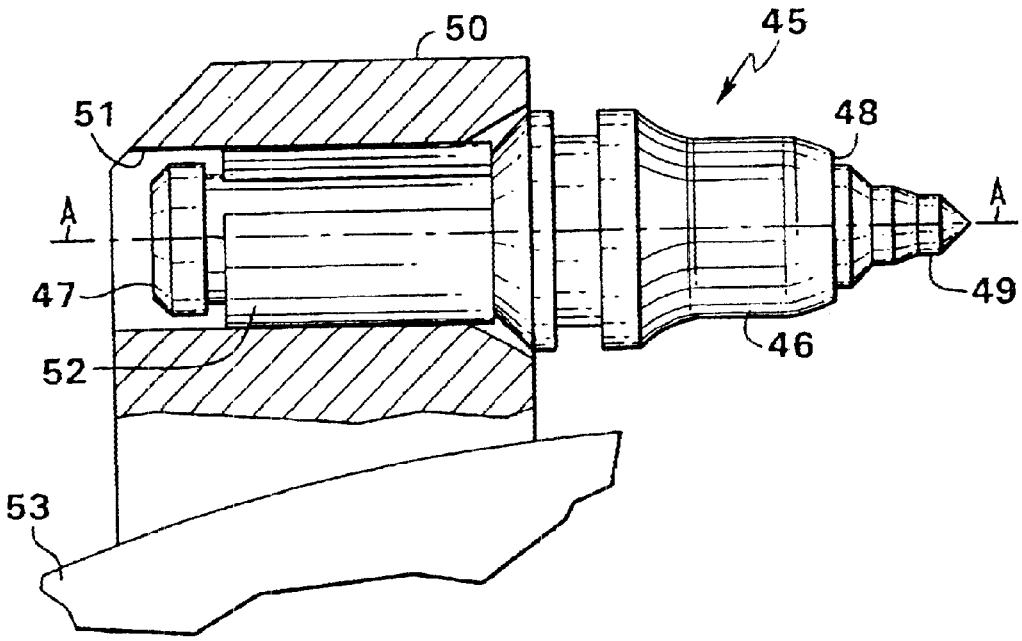
FIG. 5: is a side view of a rotatable pick-style tool rotatably held in a block, wherein a portion of the block has been removed to show the pick-style tool, e.g., a road planing tool mounted to a road planing drum or a mining tool mounted to a mining drum.

Turning now to FIG. 5, this is a copy of FIG. 1 from U.S. Pat. No. 6,170,917 issued to Heinrich et al. on Jan. 9, 2001, having the title, "Pick-style tool with a cermet insert having a Co—Ni—Fe-binder," from which figure copy all of the reference numerals present in the original figure, as it appears in U.S. Pat. No. 6,170,917, have been removed. U.S. Pat. No. 6,170,917 is hereby incorporated by reference as if set forth in its entirety herein. The reference numerals that have been removed from the figure for this U.S. Pat. No. 6,170,917, essentially reproduced herein as FIG. 5, indicate arrangements that are well known in the prior art.

Thus, FIG. 5 illustrates a pick-style tool that includes an elongate tool body with an axially forward end and an axially rearward end, and a hard insert affixed to the tool body at the axially forward end. The hard insert possibly comprises a cermet comprising tungsten carbide and a binder comprising cobalt, nickel, and iron. The binder comprising cobalt, nickel, and iron is unique in that even when subjected to plastic deformation, the binder substantially maintains its face centered cubic (fcc) crystal structure and avoids stress and/or strain induced transformations. FIG. 5 is a side view of a rotatable pick-style tool rotatably held in a block, wherein a portion of the block has been removed to show the pick-style tool, e.g., a road planing tool mounted to a road planing drum or a mining tool mounted to a mining drum.

More particularly, in FIG. 5 there is illustrated a rotatable pick-style tool generally designated as 45. A road planing tool as well as a pick-style mine tool are each considered to be a rotatable pick-style tool 45. Pick-style tool 45 has an elongate steel body 46 that has an axially rearward end 47 and an opposite axially forward end 48. A hard insert, or tip, 49 is affixed in a socket in the axially forward end 48 of the tool body 46.

The pick-style tool 45 is rotatably carried by a block 50. Block 50 contains a bore 51 in which the rearward portion, or shank, of the tool 45 is retained by the action of a resilient retainer sleeve 52 such as that described in U.S. Pat. No. 4,201,421 to DenBesten et al., which is hereby incorporated by reference as if set forth in its entirety herein. The block 50 may be mounted to a drum 53, either road planing or mining, or other drive mechanism known in the art such as, for example, a chain. During operation, the pick-style tool 45 rotates about its central longitudinal axis A—A. Further description of the road planing tool 45, and especially the geometry of the hard insert 49, is found in U.S. Pat. No. 5,219,209 to Prizzi et al. entitled, "Rotatable cutting bit insert, assigned to KENNAMETAL INC. of Latrobe, Pa., the assignee of the present invention. U.S. Pat. No. 5,219,209 is hereby incorporated by reference as if set forth in its entirety herein.

Figure 6:
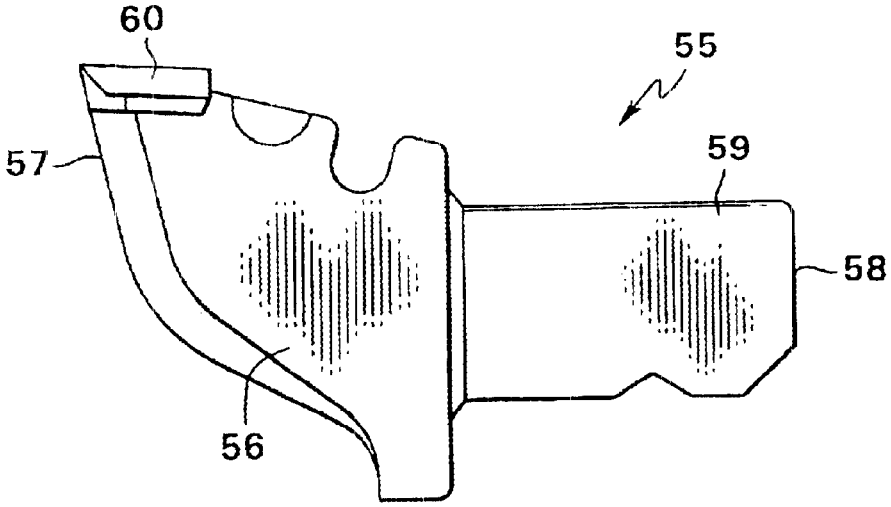
FIG. 6: shows a side view of a longwall style mine tool which is held in a non-rotatable manner, i.e., a non-rotatable pick-style mine tool, by a holder mounted to a drive chain or other driven member.

Turning to FIG. 6, this is a copy of FIG. 2 from U.S. Pat. No. 6,170,917 issued to Heinrich et al. on Jan. 9, 2001, having the title, "Pick-style tool with a cermet insert having a Co—Ni—Fe-binder," from which figure copy all of the reference numerals present in the original figure, as it appears in U.S. Pat. No. 6,170,917, have been removed. U.S. Pat. No. 6,170,917 is hereby incorporated by reference as if set forth in its entirety herein, as mentioned above. The reference numerals that have been removed from the figure for this U.S. Pat. No. 6,170,917, essentially reproduced herein as FIG. 6, indicate arrangements that are well known in the prior art. FIG. 6 shows a side view of a longwall style mine tool which is held in a non-rotatable manner, i.e., a non-rotatable pick-style mine tool, by a holder mounted to a drive chain or other driven member.

Referring to FIG. 6, there is illustrated a non-rotatable longwall style of mine tool generally designated as 55. The longwall mine tool 55 is considered to be a pick-style mine tool. Longwall tool 55 has an elongate steel body 56 with a forward end 57 and a rearward end 58. The body 56 presents a rearward shank 59 adjacent to the rearward end 58 thereof. The rearward shank 59 is of a generally rectangular cross-section. A hard insert 60 is affixed in a socket at the forward end 57 of the tool body 56. During operation, the longwall tool 55 does not rotate about its central longitudinal axis.

Figure 7:
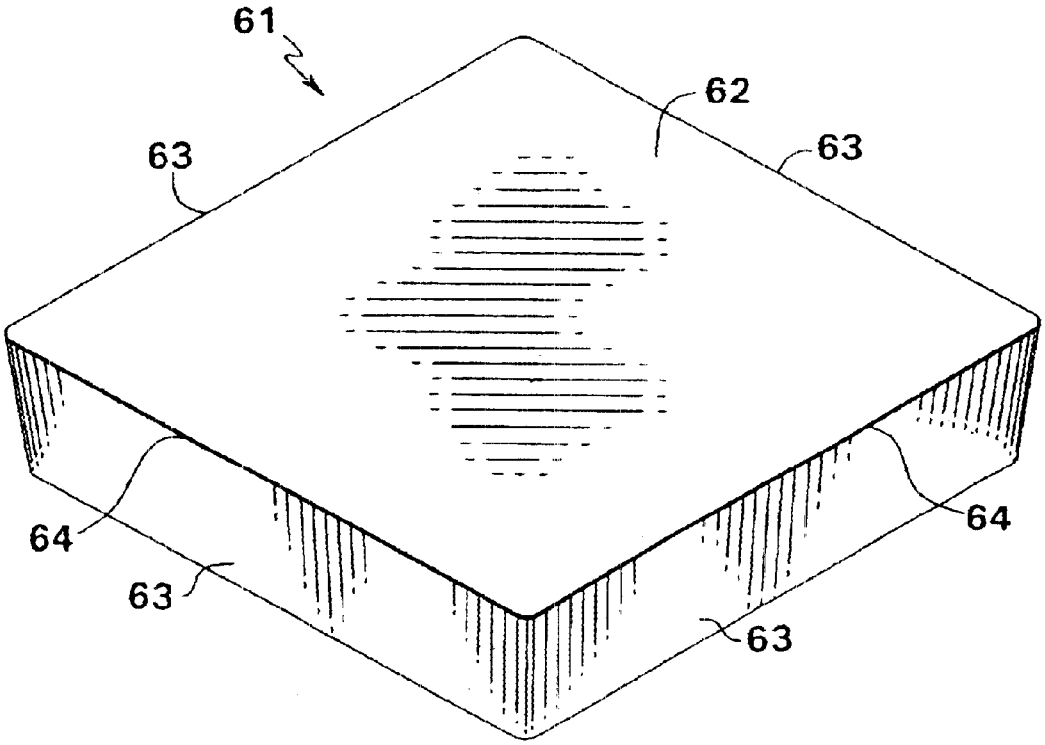
FIG. 7: shows an embodiment of a cutting tool in accordance with an embodiment of the present invention.

Turning now to FIG. 7, this is a copy of FIG. 1 from U.S. Pat. No. 6,010,283 issued to Heinrich et al. on Jan. 4, 2000, having the title, "Cutting insert of a cermet having a Co—Ni—Fe-binder," from which figure copy all of the reference numerals present in the original figure, as it appears in U.S. Pat. No. 6,010,283, have been removed. U.S. Pat. No. 6,010,283 is hereby incorporated by reference as if set forth in its entirety herein. The reference numerals that have been removed from the figure for this U.S. Pat. No. 6,010,283, essentially reproduced herein as FIG. 5, indicate arrangements that are well known in the prior art.

FIG. 7 illustrates an embodiment of a cutting tool or cutting insert including a flank face, a rake face, and a cutting edge at the intersection of the flank and rake faces that is useful in the chip forming machining of workpiece materials. The cutting insert comprises a cermet comprising at least one hard component and a binder comprising cobalt, nickel, and iron. The binder comprising cobalt, nickel, and iron is unique in that even when subjected to plastic deformation, the binder substantially maintains its face centered cubic (fcc) crystal structure and avoids stress and/or strain induced transformations.

In accordance with this embodiment of the present invention, FIG. 7 shows an embodiment of a cutting tool comprising an indexable cutting insert 61 composed of a cermet having a binder comprising cobalt, nickel, and iron. The cutting insert 61 is used in the chip forming machining, e.g., turning, milling, grooving and threading, of workpiece materials including metals, polymers, and composites having a metallic or polymeric matrix. This invention is preferably used in the machining of metallic workpiece materials, see, e.g., KENNAMETAL Lathe Tooling Catalog 6000 and KENNAMETAL Milling Catalog 5040, and is particularly useful in roughing and interrupted cutting of these workpiece materials where a combination of high toughness and high wear resistance is required. The cutting insert 61 has a rake face 62 over which chips, formed during high speed machining of workpiece materials, flow. Joined to the rake surface 62 are flank faces 63. At the juncture of the rake face 62 and the flank faces 63 is formed a cutting edge 64 for cutting into the workpiece materials. The cutting edge 64 may be in either a sharp, honed, chamfered or chamfered and honed condition depending on application requirements. The hone may be any of the style or sizes of hones used in the industry. The cutting insert may also be made in standard shapes and sizes, for example SNGN-434T, SNGN-436T, SPGN-633T, SPGN-634T, inserts may also be made with holes therein as well.

Figure 8:
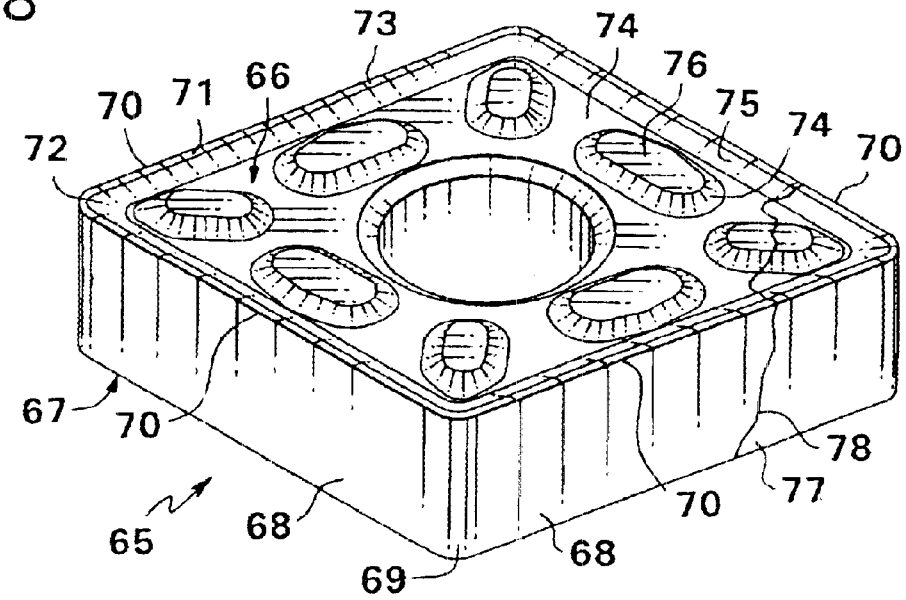
FIG. 8: shows a perspective view of an embodiment of a cutting tool with chip control surfaces integrally molded in the tool.

Turning now to FIG. 8, this is a copy of FIG. 2 from U.S. Pat. No. 6,010,283 issued to Heinrich et al. on Jan. 4, 2000, having the title, "Cutting insert of a cermet having a Co—Ni—Fe-binder," from which figure copy all of the reference numerals present in the original figure, as it appears in U.S. Pat. No. 6,010,283, have been removed. U.S. Pat. No. 6,010,283 is hereby incorporated by reference as if set forth in its entirety herein, as mentioned above. The reference numerals that have been removed from the FIG. 2 for this U.S. Pat. No. 6,010,283, essentially reproduced herein as FIG. 8, indicate arrangements that are well known in the prior art.

In the example of a cutting tool with chip control surfaces integrally molded in the tool, as depicted in a perspective view in FIG. 8, the substrate may comprise an indexable cutting insert or like cutting tool with chip control surfaces generally identified by reference numeral 65 comprising a polygonal body with a top surface 66, a bottom surface 67, and a peripheral wall with sides 68 and corners 69 extending from the top surface 66 to the bottom surface 67. At an intersection of the peripheral wall and the top surface 66 is a cutting edge 70. The top surface 66 comprises a land area 71 joining the cutting edge 70 and extending inwardly toward the center of the body. The land area 71 is comprised of corner portion land areas 72 and side portion land areas 71. The top surface 66 also comprises a floor 74 between the land area 71 and the center of the body, which is disposed at a lower elevation than the land area 71. The top surface 66 may further comprise sloping wall portions 75 inclined downwardly and inwardly from the land area 71 to the floor 74. A plateau or plateaus 76 may be disposed upon the floor 74 spaced apart from the sloping wall portions 75 and having sloped sides ascending from the floor 74. Furthermore, the bottom surface 67 of the body may have features similar to those described for the top surface 66. Regardless of its shape, the cermet 77 comprising an indexable cutting insert 65 may be at least partially coated with a coating scheme 78 and preferably in portions that contact the material to be machined and/or that has been machined.

A cutting tool of the present invention may be advantageously used at cutting speeds, feeds, and depths of cut (DOC) that are compatible with achieving the desired results. Furthermore, the cutting tools of the present invention may be used either with or without a cutting or cooling fluid.

The cermet from which the cutting insert 61 of FIG. 7 or the hard insert 65 of FIG. 8 are made of a cermet comprising a binder comprising cobalt, nickel, and iron and at least one hard component. The binder comprising cobalt, nickel, and iron is unique in that even when subjected to plastic deformation, the binder maintains its face centered cubic (fcc) crystal structure and avoids stress and/or strain induced transformations. Applicants believe that substantially no stress and/or strain induced phase transformations occur in the binder comprising cobalt, nickel, and iron up to those stress and/or strain levels that leads to superior performance.

A cermet tool of the present invention may be used either with or without a coating. If the cutting tool is to be used with a coating, then the cutting tool is coated with a coating that exhibits suitable properties such as, for example, lubricity, wear resistance, satisfactory adherence to the cermet, chemical inertness with workpiece materials at material removal temperatures, and a coefficient of thermal expansion that is compatible with that of the cermet (i.e., compatible thermo-physical properties). The coating may be applied via CVD and/or PVD techniques, cf. U.S. Pat. Nos. 5,250,367; 5,364,209; 6,063,707; 6,211,082; 6,235,646 and 6,254,933.

Figure 9:
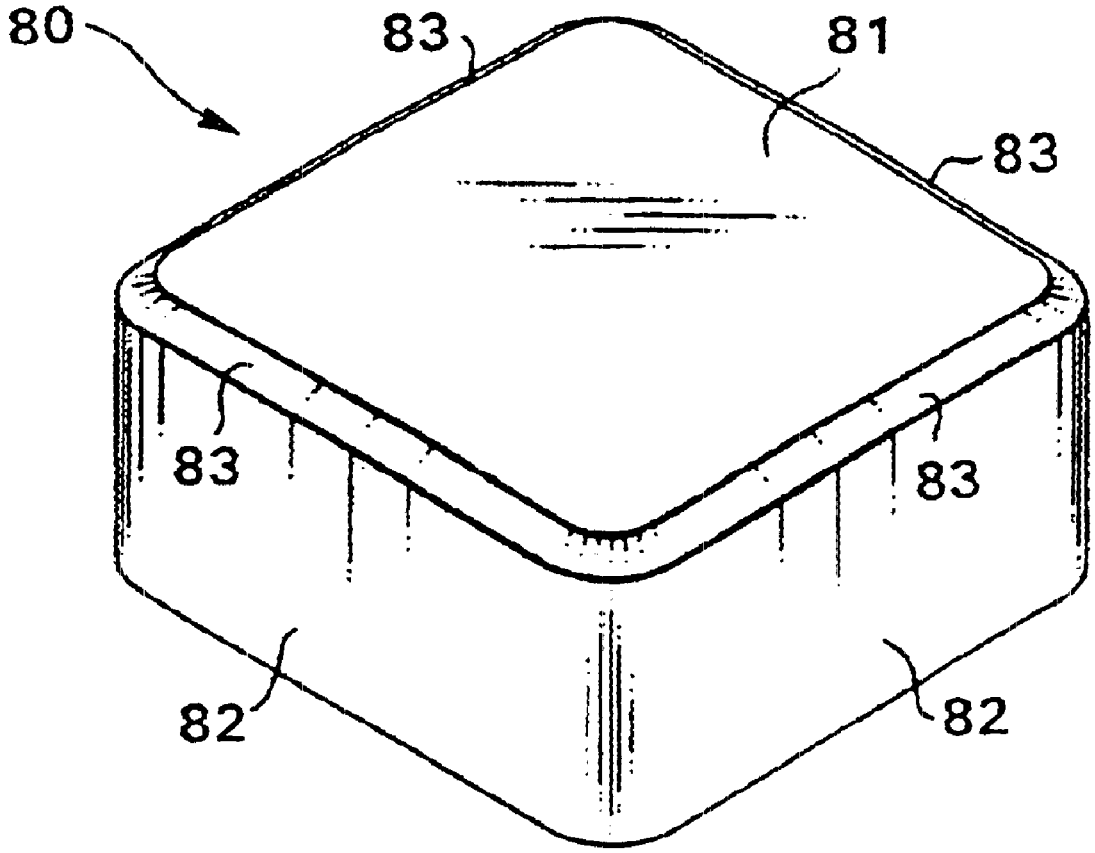
FIG. 9: shows an embodiment of a cutting tool, such as a cemented carbide tool, in accordance with the present invention.

FIG. 9 illustrates a cermet or cemented carbide tool which has particular usefulness as a cutting tool for the machining of alloys at high speeds.

FIG. 9 is a copy of FIG. 1 from U.S. Pat. No. 5,427,987 issued to Mehrotra et al. on Jun. 27, 1995, having the title, "Group IV boridebased cutting tools for machining group IVB based materials," from which figure copy all of the reference numerals present in the original figure, as it appears in U.S. Pat. No. 5,427,987, have been removed. U.S. Pat. No. 5,427,987 is hereby incorporated by reference as if set forth in its entirety herein. The reference numerals that have been removed from the FIG. 1 for this U.S. Pat. No. 5,427,987, essentially reproduced herein as FIG. 9, indicate arrangements that are well known in the prior art.

Thus, FIG. 9 shows an embodiment of an indexable metalcutting insert 80 composed of material discovered by the present inventors. This embodiment of the present invention is preferably used in the chip forming machining, e.g., turning, milling, grooving, threading, drilling, boring, sawing.

The cutting tool 80 has a rake face 81 over which chips formed during said machining flow. Joined to the rake face 81 is at least one flank face 82. At at least one juncture of the rake face 81 and flank faces 82, a cutting edge 83 is formed, for cutting into the material at hand.

While the cutting edge 83 may be in a sharp, honed, chamfered, or chamfered and honed condition, it is preferred that it be in a chamfered condition, an embodiment of which is illustrated in FIG. 9.

Figure 10:
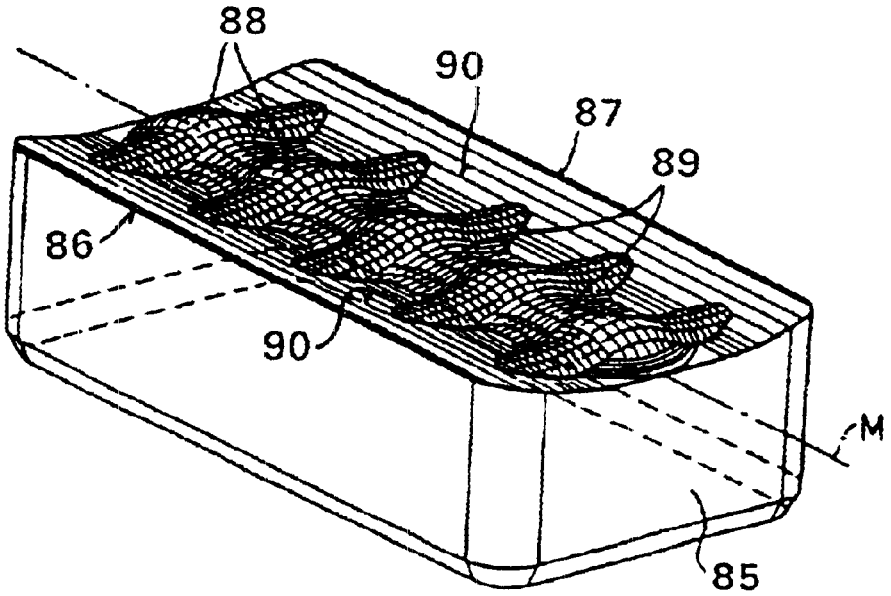
FIG. 10: is a diagrammatic perspective representation of an indexable insert, whose top surface is indicated by intersecting grid lines, in accordance with one embodiment of the present invention.
Figure 11:
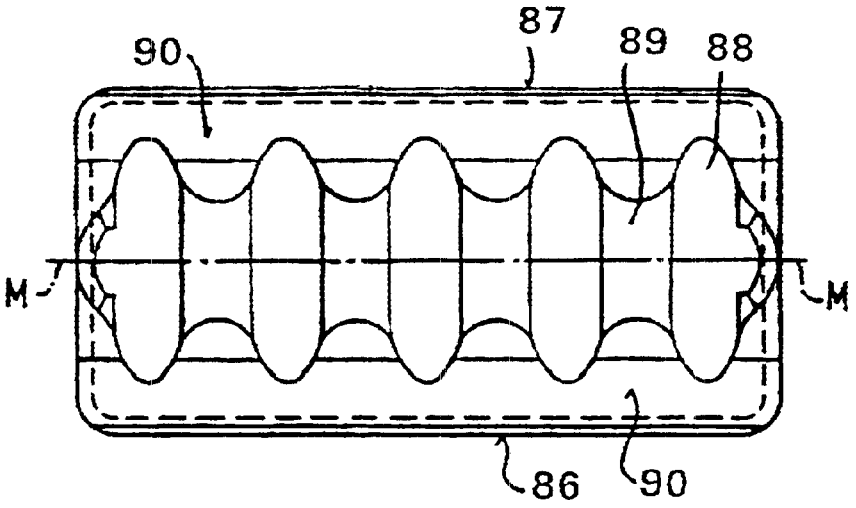
FIG. 11: is a top plan view of the indexable insert embodiment shown in FIG. 10.

Turning now to FIGS. 10 and 11, these are copies of FIGS. 1 and 2 from U.S. Pat. No. 5,788,427 issued to Zitzlaff et al. on Aug. 4, 1998, having the title, "Indexable insert," from which figure copy all of the reference numerals present in the original figure, as it appears in U.S. Pat. No. 5,788,427, have been removed. U.S. Pat. No. 5,788,427 is hereby incorporated by reference as if set forth in its entirety herein. The reference numerals that have been removed from the FIGS. 1 and 2 for this U.S. Pat. No. 5,788,427, essentially reproduced herein as FIG. 10, indicate arrangements that are well known in the prior art.

FIGS. 10 and 11, respectively a diagrammatic perspective representation and top plan view, illustrate an indexable insert having two parallel cutting edges on opposite sides of an indexable insert body in the form of a rectangular block. In the intermediately placed top surface descending toward the center line (M) there is a chipbreaking structure comprising alternating projections and recesses. These projections and recesses constitute a row, centered on the center line (M), of spherical-like chipbreaking bodies, between which concave chip guiding surfaces are formed. During metalcutting operations, this provides an even flow of chips with the formation of short chips which are free of grooves and tears along the edges.

More particularly, the indexable insert illustrated in FIGS. 10 and 11 comprises an indexable insert body 85 of a generally rectangular block having a flat base surface, four side surfaces extending perpendicularly to such base surface and a top surface, which possesses inwardly descending top surface parts and a chipbreaking structure arranged along the center line M of the indexable insert body 85. Two cutting edges 86 and 87 are formed at the same level and are parallel to one another between the top surface and the two longer side surfaces.

The chipbreaking structure comprises generally part-spherical projections 88 in a row centered on the center line M of the cover surface, such projections alternating with concave recesses. When considered in a section along the center line M, the projection 88 and the recesses 89 define a continuous undulating line, whose crests rise above the cutting edges 86 and 87 and whose troughs are lower than such cutting edges 86 and 87. The top surface respectively has, extending inward from a cutting edge part in the direction of the center line M, a descending top surface part 90, which, rising again toward the center line M, merges with the projections 88 and the recesses 89.

Figure 12:
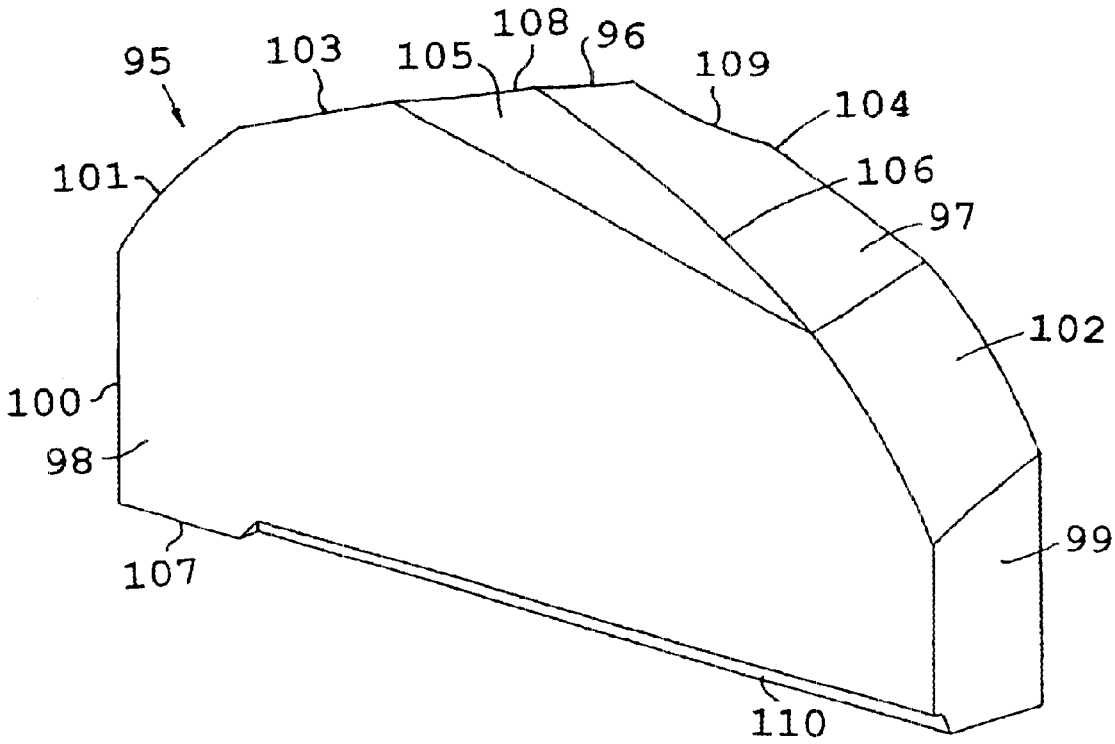
FIG. 12: is an isometric view of a cutting insert in accordance with one embodiment of the present invention.

Turning now to FIG. 12, this is a copy of FIG. 2 from U.S. Pat. No. 6,145,606 issued to Haga on Nov. 14, 2000, having the title, "Cutting insert for roof drill bit," from which figure copy all of the reference numerals present in the original figure, as it appears in U.S. Pat. No. 6,145,606, have been removed. U.S. Pat. No. 6,145,606 is hereby incorporated by reference as if set forth in its entirety herein. The reference numerals that have been removed from the FIG. 2 for this U.S. Pat. No. 6,145,606, essentially reproduced herein as FIG. 12, indicate arrangements that are well known in the prior art.

Thus, FIG. 12 is an isometric view of a cutting insert. The cutting insert comprises a pair of top surfaces which intersect to form a chisel edge, and a pair of concave surfaces wherein each one of the concave surfaces is adjacent to and intersects its corresponding one of the top surfaces. The cutting insert further includes a pair of end surfaces and a pair of arcuate surfaces. One of the arcuate surfaces intersects the one top surface and further intersects the one end surface whereby the one arcuate surface joins the one top surface and the one end surface. The other of the arcuate surfaces intersects the other top surface and further intersects the other end surface whereby the other arcuate surface joins the other top surface and the other end surface.

More particularly, with reference to FIG. 12, the geometry of the cutting insert 95, comprises a chisel edge 96 wherein a pair of opposite top surfaces, of which surface 97 can be seen, which are disposed on either side of the chisel edge 96. The top surfaces intersect to form the chisel edge 96. The top surfaces are disposed with respect to one another at an included angle of about 140 degrees.

The cutting insert 95 further has a pair of side surfaces, of which side surface 98 can be seen. The side surfaces are generally parallel to one another. The cutting insert 95 also has a pair of generally parallel end surfaces, of which one can be seen at 99 wherein the end surfaces join together the side surfaces (98 only of which can be seen). The one end surface intersects the one side surface 98 to form one side clearance cutting edge 100. The other end surface 99 intersects the other side surface to form the other side clearance cutting edge. The end surfaces (99 of which only can be seen) each are disposed at a relief angle of about 6.5 degrees. The relief angle is the included angle between the end surface and a vertical plane perpendicular to the side surfaces (98 of which only can be seen) of the cutting insert 95.

The cutting insert 95 has one arcuate surface portion 101 that joins the one top surface with the one end surface. Arcuate surface 101 is disposed with respect to a plane perpendicular to the side surface, i.e., a horizontal plane, at an included angle equal to about 18 degrees. Another arcuate surface 102 joins the other top surface 97 with the other end surface 99. Arcuate surface 102 is disposed with respect to a plane perpendicular to the side surface, i.e., a horizontal plane, at an included angle equal to about 18 degrees.

Each arcuate surface (101, 102) is further disposed so that the tangent to each arcuate surface passing through the midpoint along the circumference thereof has an included angle of disposition with respect to the vertical equal to about 45 degrees.

Each one of the top surfaces (97 of which only can be seen) is disposed with respect to a plane perpendicular to the side surface, i.e., a horizontal plane, at an included angle of about 18 degrees.

The one side surface 98 intersects the one top surface to form a leading cutting edge 103. The other side surface intersects the other top surface 97 to form a trailing cutting edge 104.

The cutting insert 95 further has one concave surface 105 which joins the one side surface 98 with the other top surface 97. The one concave surface 105 intersects the one side surface 98 to form an edge, not shown, which is disposed at an angle with respect to a horizontal line that is equal to about 12 degrees. The one concave surface 105 intersects the one top surface to form another edge 106.

Another concave surface, not shown, joins the other side surface with the one top surface 98. The other concave surface intersects the one side surface to form an edge, not shown, which is disposed at an angle with respect to a horizontal line equal to about 12 degrees. The other concave surface intersects the other top surface 97 to form another edge.

The one concave surface intersects the one top surface 98 so as to form one scallop 108 at the intersection thereof. It becomes apparent that the leading cutting edge 103 presents three separate portions, or lengths. These portions comprise an arcuate portion which is defined by the edge at the intersection of the one side surface 98 and the arcuate surface 101, a scalloped portion which is defined by the intersection of the one concave surface with the one top surface, and a straight portion which is mediate of the arcuate portion and the scalloped portion wherein the straight portion is defined by the intersection of the one side surface 98 and the one top surface, not shown.

The other concave surface, not shown, intersects the other top surface, not shown, so as to form another scallop 109 at the intersection thereof. Like for the leading cutting edge 103, it becomes apparent that the trailing cutting edge 104 presents three separate portions, or lengths. These portions comprise an arcuate portion which is defined by the edge at the intersection of the other side surface, not shown, and the arcuate surface 102, a scalloped portion which is defined by the intersection of the other concave surface with the other top surface 97, and a straight portion which is mediate of the arcuate portion and the scalloped portion wherein the straight portion is defined by the intersection of the other side surface 48 and the other top surface 97.

The cutting insert has a bottom surface 107. Bottom surface 107 contains a pair of opposite elongate notches of which one can be seen at 110.

Figure 13:
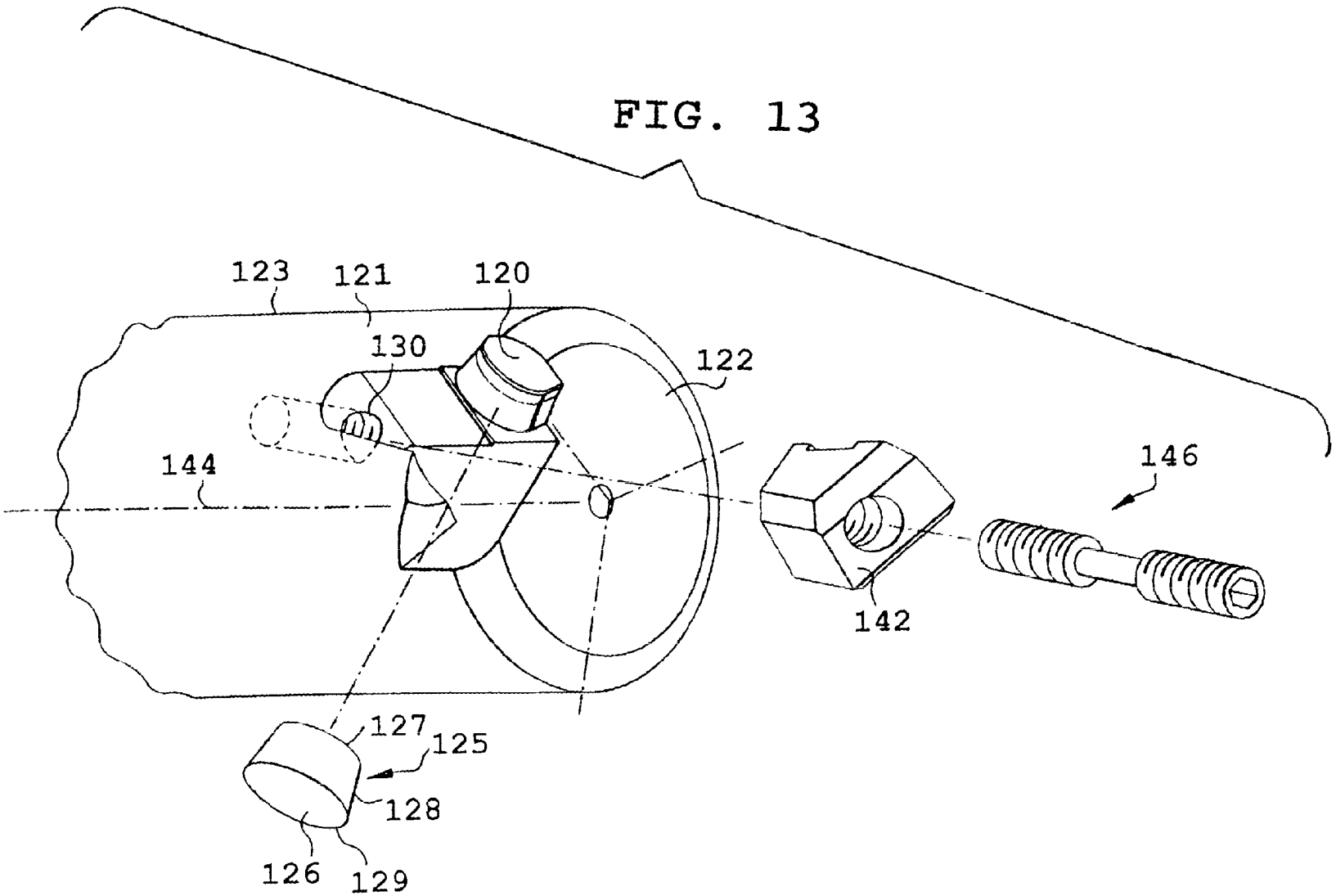
FIG. 13: illustrates an exploded perspective view of a high speed milling cutter with an insert in accordance with one embodiment of the present invention.

Turning now to FIG. 13, an exploded perspective view, of a high speed milling cutter using a wedge to secure an insert within a pocket of the milling cutter wherein the wedge is tapered in both the axial direction and the radial direction. A screw urges the wedge within a tapered cavity to press the insert within the pocket along the axial wedge angle while rotation of the cutter creates centrifugal forces urging the wedge radially outward, thereby forcing the wedge against the radial wedge surface to further compress the insert within the pocket. The insert pocket may be extended to radially encompass the insert, thereby providing additional support against centrifugal forces for the insert.

More particularly, FIG. 13 is a copy of FIG. 2 from U.S. Pat. No. 5,967,706 issued to Hughes, Jr. on Oct. 19, 1999, having the title, "High speed milling cutter," from which figure copy all of the reference numerals present in the original figure, as it appears in U.S. Pat. No. 5,967,706, have been removed. U.S. Pat. No. 5,967,706 is hereby incorporated by reference as if set forth in its entirety herein. The reference numerals that have been removed from the FIG. 2 for this U.S. Pat. No. 5,967,706, essentially reproduced herein as FIG. 13, indicate arrangements that are well known in the prior art.

Thus, as illustrated in the exploded perspective view of FIG. 13, the insert pocket 120 is recessed within the peripheral wall 121 at the front end 122 of the body 123. The insert 125 is positioned within the insert pocket 120 and has a top face 126 and a bottom face 127 with a side wall 128 therebetween. The side wall 128, which may be conical in shape in one embodiment, intersects with the top face 126 to define a cutting edge 129. While the top face 126 of the insert 125 illustrated in FIG. 13 is circular, it should be understood this shape is merely one geometry of many geometries suitable for use with the subject invention. The insert 125 may be made of the material of this invention.

The wedge cavity 130 is recessed within the peripheral wall 121 and is adjacent to the insert pocket 120 at the front end 122 of the body 123.

The wedge 142 may be moved within the wedge cavity 130 in a direction generally along the longitudinal axis 144. The wedge 142 can be secured by a screw 146, as is apparent from the incorporated reference.

Figure 14:
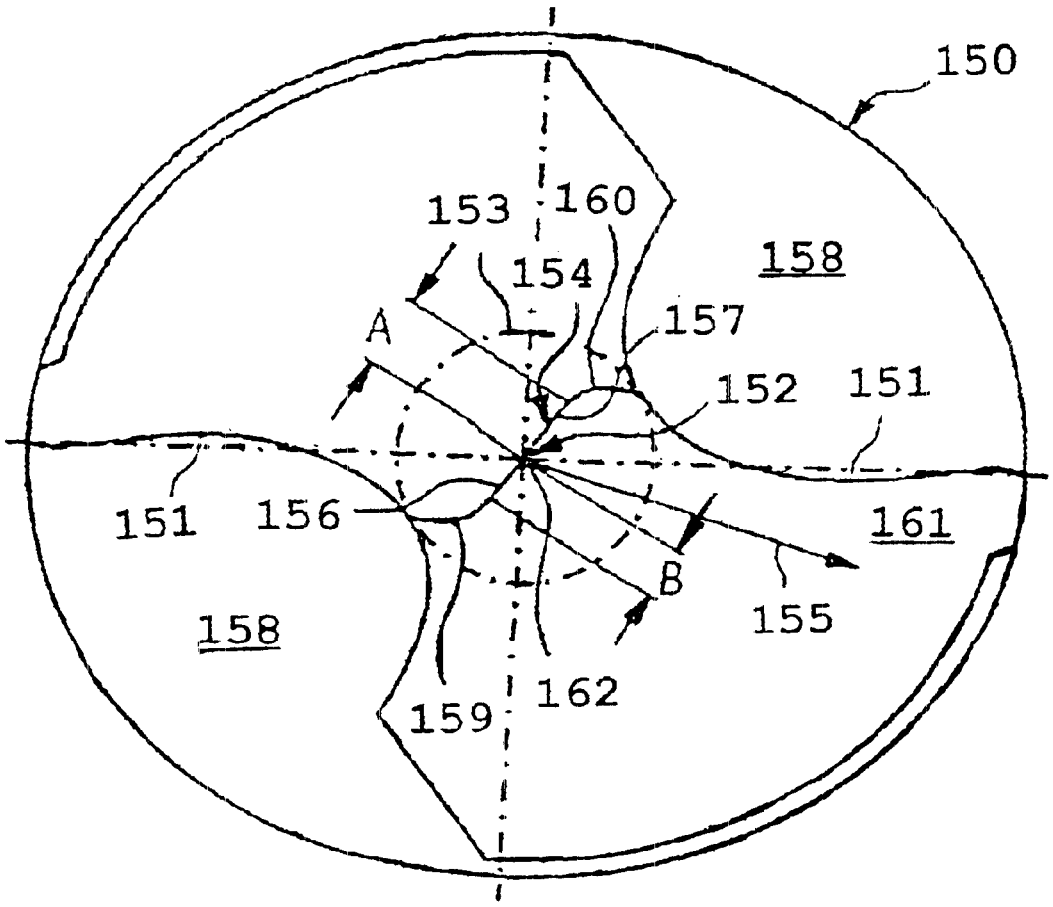
FIG. 14: is a top plan or end view of a drill in accordance with one embodiment of the present invention.

Turning now to FIG. 14, an end view of a drill which is designated 150 overall, contains two primary cutting edges 151. The chip faces 161 of the primary cutting edges 151 lie in the vicinity of chip flutes or chip grooves 158. The primary cutting edges 151 are symmetrical with respect to the drill axis 152, which runs perpendicular to the plane of the drawing in FIG. 14 and contains the drill tip 162. The drill center web 153, which is indicated by a circle drawn in a broken or dot-dash line, is spanned on its end surface containing the drill tip 162 by the total chisel edge 154. The chisel edge 154 is characterized, when seen in an overhead view of the drill tip 162 (FIG. 14) by an S-shape, which with its two curved edges transitions into or forms an oblique angle W1 or W2 with respect to the primary cutting edges 151, namely in the radial direction 155 outward in relation to FIG. 14.

The total chisel edge 154 is formed by two individual chisel edges 156, 157, the chip faces of which lie in the vicinity of the drill center web 153, and which extend outward from the drill axis 152 in the radial direction 155 to the chip flutes or chip grooves 158. The two individual chisel edges 156, 157, in the exemplary embodiment illustrated in FIG. 14, have different lengths up to their transition into their chisel edge radii 159, 160, as indicated by the different dimensions A and B in FIG. 14. To achieve a desired asymmetry, therefore, the variable parameters that are available include the lengths A and B (FIG. 4), the individual chisel edges 156, 157, the chisel edge radii R1 and R2 (not shown), and/or the different angles W1 and W2. The desired asymmetry or the desired asymmetries can be achieved both by differences in only one of the parameters listed above, or differences in two parameters together, or for that matter differences in all three parameters.

Figure 15:
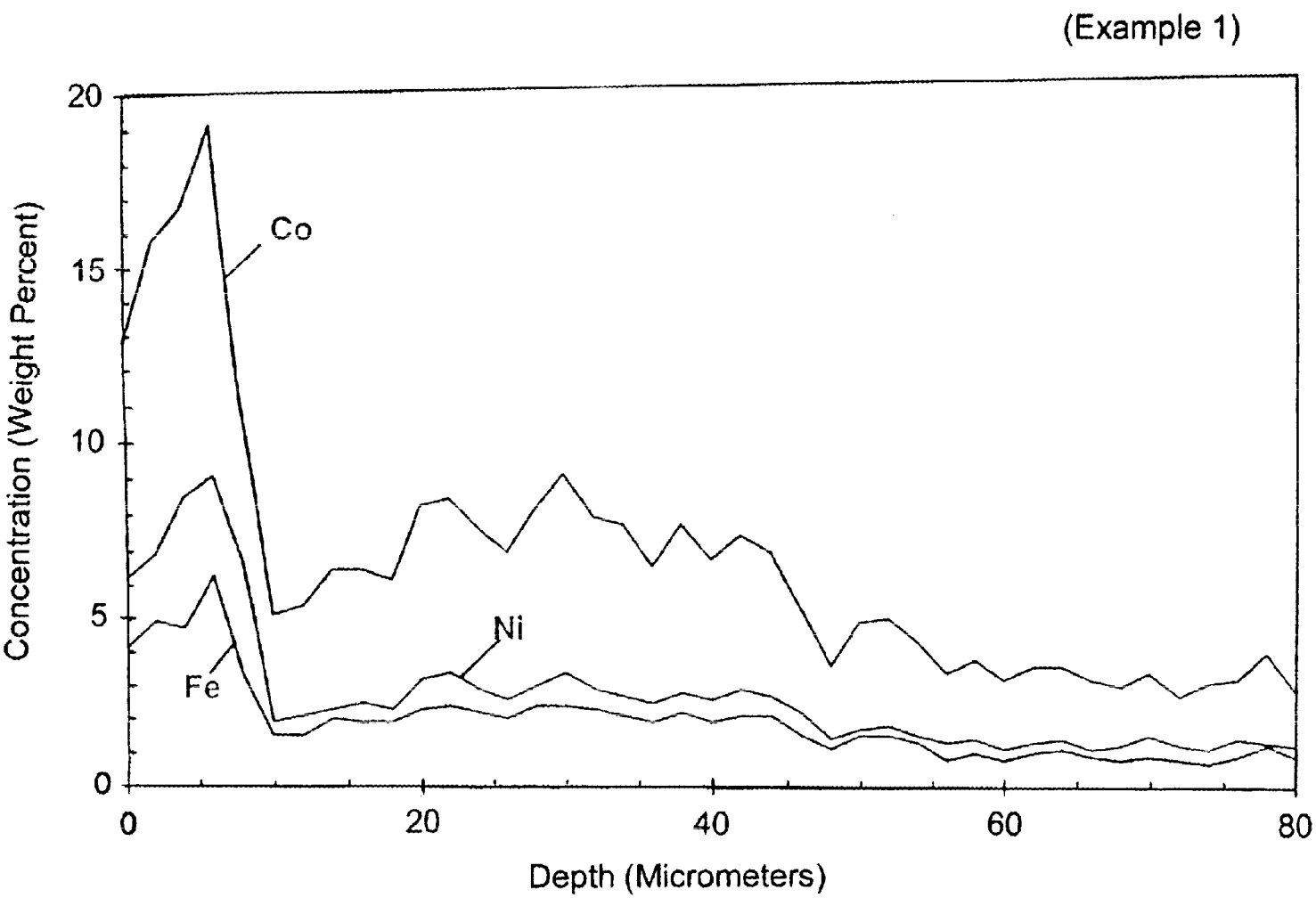
FIG. 15: is a graph depicting the energy dispersion spectra (EDS) for the sintered cemented carbide body obtained in accordance with Example 1.
Figure 16:
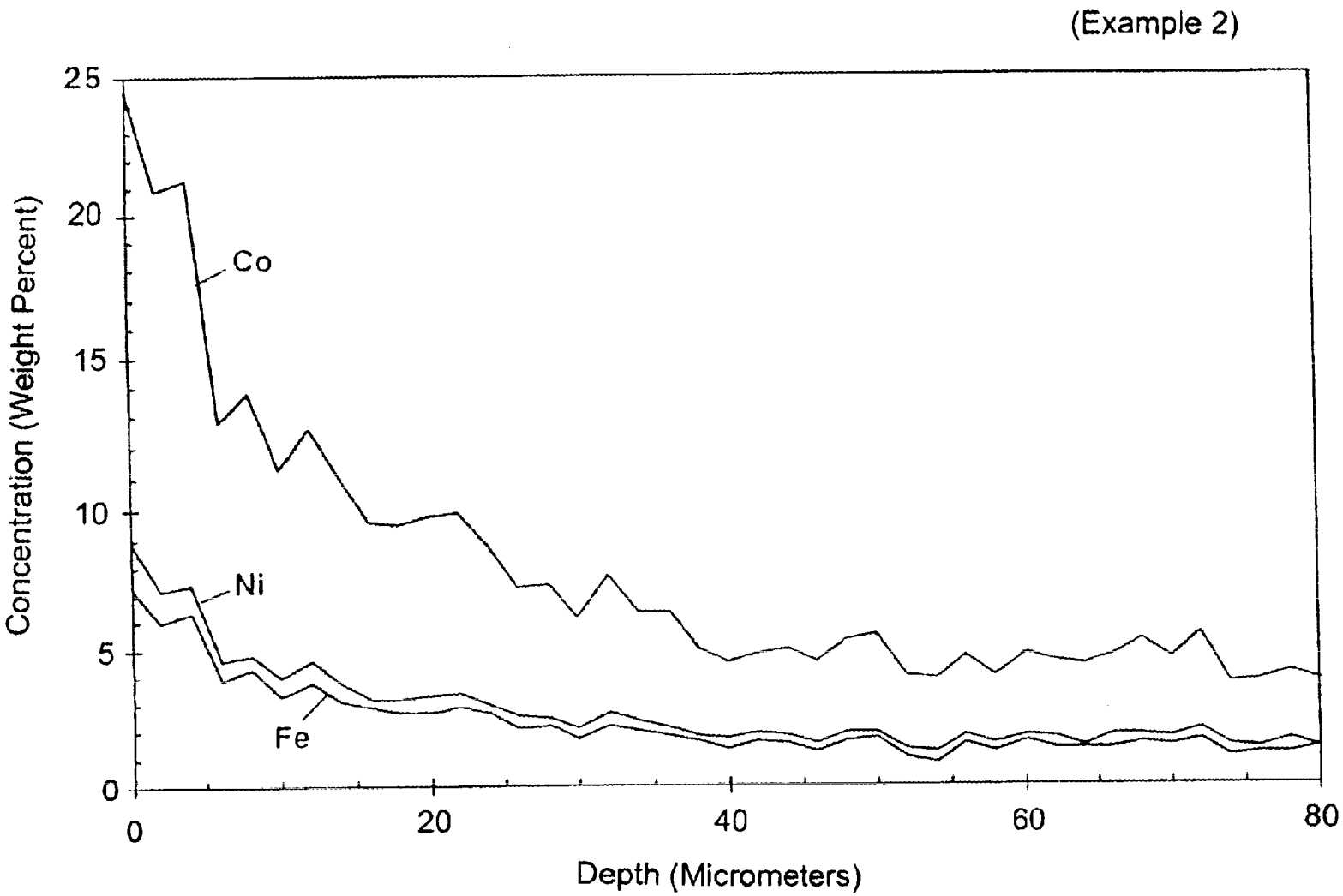
FIG. 16: is a graph depicting the energy dispersion spectra (EDS) for the sintered cemented carbide body obtained in accordance with Example 2.
Figure 17:
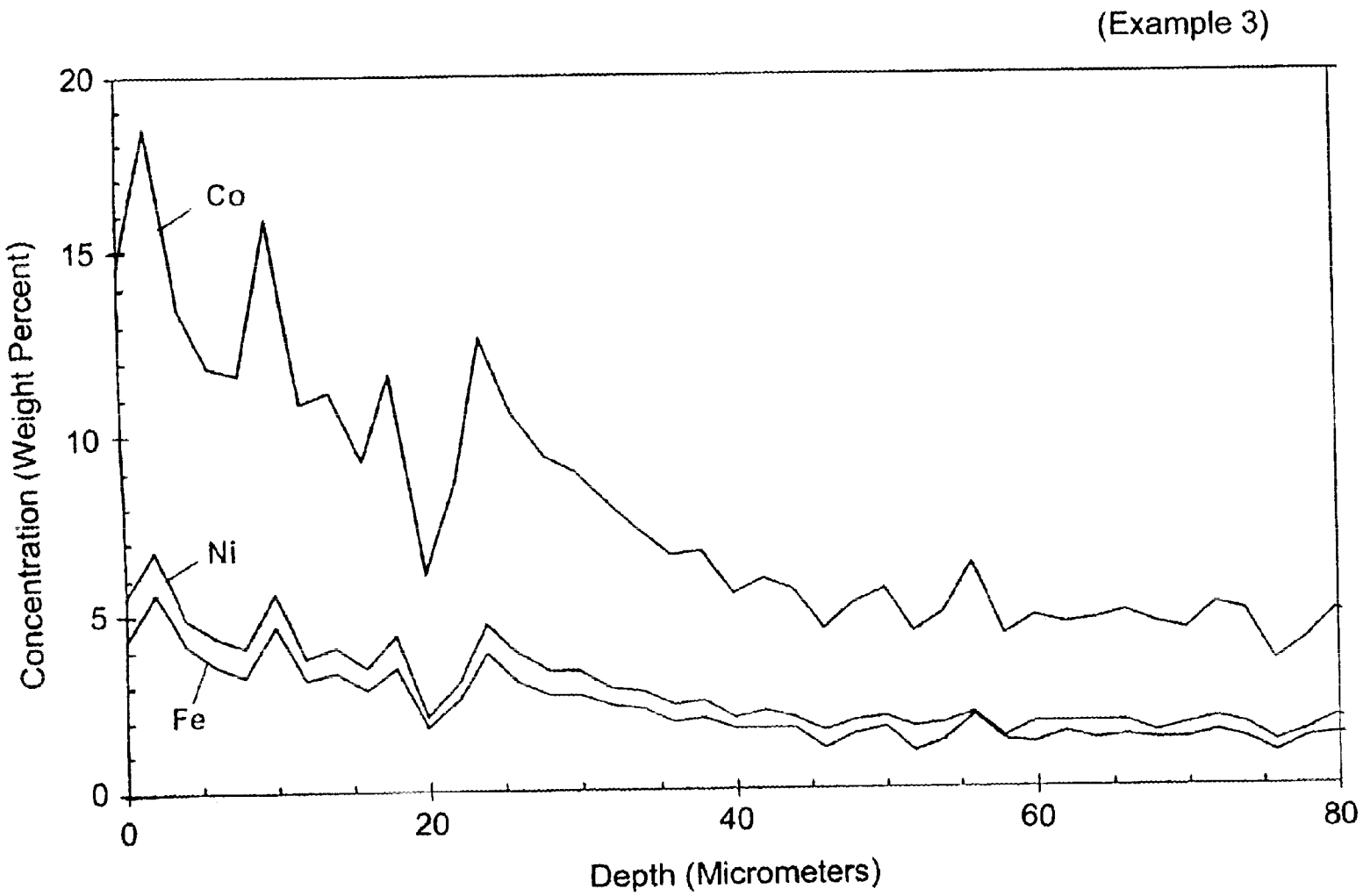
FIG. 17: is a graph depicting the energy dispersion spectra (EDS) for the sintered cemented carbide body obtained in accordance with Example 3.

FIGS. 15 to 17 are energy dispersion spectra (EDS) of the binders comprising cobalt, nickel, and iron of the sintered cemented carbide bodies which have been made in accordance with Examples 1 to 3. In the Figures, the K-lines of the three elements, cobalt, nickel and iron (Co, Ni and Fe), of the respective binder alloy show the concentrations of the elements as a function of the layer depth, i.e. the distance from a surface of the sintered cemented carbide body.

Thus, FIGS. 15 to 17 can possibly be derived from data correlating the distribution of elements (determined in a scanning electron microscope by energy dispersive spectroscopy using a JSM-6400 scanning electron microscope (Model No. ISM65-3, JEOL LTD, Tokyo, Japan) equipped with a $LaB_6$ cathode electron gun system and an energy dispersive x-ray system with a silicon-lithium detector (Oxford Instruments Inc., Analytical System Division, Microanalysis Group, Bucks, England) in a sample of material to the microstructural features thereof.

The preparation of the sintered cemented carbide bodies possibly comprises preparation of possible starting powder blends and possible subsequent processing that is well known in the art, and as described in, for example, "World Directory AND HANDBOOK OF HARDMETALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); "CERMET-HANDBOOK", Hertel A G, Werkzeuge+Hartstoffe, Fuerth, Bavaria, Germany (1993); and "CEMENTED CARBIDES", by P. Schwarzkopf & R. Kieffer, The Macmillan Company (1960), the subject matter of which is herein incorporated by reference in its entirety.

EXAMPLE 1

First, a powder blend consisting of 94 weight percent hard components and 6 weight percent binder metal is prepared in accordance with common powder metallurgy methods. The powder blend had the following composition (in weight percent, respectively, as related to the overall amount of the powder blend):

- 86.5 weight percent of tungsten carbide (% WC) of a particle size of 5.0 micrometers ($\mu$m)
- 5.0 weight percent of 70 percent tantalum (niobium) and 30 percent carbide (% Ta(Nb)C) 70/30)
- 1.8 weight percent of 70 percent titanium and 30 percent carbonitride (% TiCN 70/30)
- 0.7 weight percent of titanium carbide (% TiC)
- 3.6 weight percent of cobalt (% Co)
- 1.2 weight percent of nickel (% Ni)
- 1.2 weight percent of iron (% Fe).

Since the hard component mixture contains 1.8 percent titanium carbonitride, this composition is referred to by those of ordinary skill in the art as having a "nitrogen enrichment" in the powder blend.

From this powder blend cuboid-shaped cutting insert blanks (green bodies) were then made in a conventional manner and were compressed to form compacts. The compacts were sintered and/or hot isostatically pressed, preferably using the known "sinter HIPping" process, at temperatures between approx. 1300 and 1760 degrees Celsius, preferably between approx. 1400 and 1600 degrees Celsius, and under pressures between approx. 1.7 and 206 MPa. Sintering is preferably performed under a reduced pressure or in an inert gas atmosphere or a reducing gas atmosphere, with special temperature-time cycles being applied.

The sintered cemented carbide body made in this way had the following physical properties:

Density: 13.96 g/cm$^3$

Magnetic saturation: 114 [4πσ]

Magnetic field strength (Hc): 99[Oe]

Vickers hardness (HV30): 1510

Porosity: <A02 e.B (The porosity of cemented carbides is classified as follows in accordance with ASTM:

Type A: pores smaller than 10 micrometers (μm) in diameter;

Type B: pores between 10 and 40 micrometers (μm) in diameter;

Type C: irregular pores caused by free carbon.) The distribution of the three elements of the binder alloy and their concentration gradient which in each case increases from the interior of the body in the direction toward the surface thereof is apparent from FIG. 15. The binder enrichment is located in a zone of a depth of up to about 40 micrometers (μm) (distance from the original surface) (cf. FIG. 1).

EXAMPLE 2

A powder blend of the following composition was prepared:

86.5 weight percent of tungsten carbide (% WC) (mean particle size of 5.0 micrometers (μm))

5.0% weight percent of 70 percent tantalum (niobium) and 30 percent carbide (% Ta(Nb)C 70/30)

2.5 weight percent of titanium carbide (% TiC)

3.6 weight percent of cobalt (% Co)

1.2% weight percent of nickel (% Ni)

1.2% weight percent of iron (% Fe).

This powder blend was used to make sintered cemented carbide bodies, as described in Example 1. In this case the hard component mixture did not contain carbonitride, but only carbides, which is why the hard component mixture is referred to as having a "carbon enrichment" (carbon (C) content in excessive stoichiometric ratio).

The physical properties of the sintered cemented carbide bodies made in this way were as follows:

Density: 13.87 g/cm3

Magnetic saturation: 118 [4πσ]

Magnetic field strength (Hc): 103 [Oe]

Vickers hardness (HV30): 1510

Porosity: <A02 e.B C06.

FIG. 16 shows the distribution of the elements in the binder alloy of the cermets thus made. A zone free of free carbon was determined at a depth between approx. 150 and 250 micrometers (μm).

EXAMPLE 3

A powder blend of the following composition was prepared:

86.5 weight percent of tungsten carbide (% WC) (mean particle size of 5.0 micrometers (μm))

5.0 weight percent of 70 percent tantalum (niobium) and 30 percent carbide (% Ta(Nb)C 70/30)

2.0 weight percent of titanium carbide (% TiC)

0.5 weight percent of 70 percent titanium and 30 percent carbonitride (% TiCN 70/30)

3.6 weight percent of cobalt (% Co)

1.2 weight percent of nickel (% Ni)

1.2 weight percent of iron (% Fe).

Apart from a carbon (C) content in an excessive stoichiometric ratio, in this case the hard component mixture contained both titanium carbonitride and titanium carbide and furthermore tantalum niobium carbide, besides tungsten carbide as the main constituent or constituents.

Sintered cemented carbide bodies were made from this powder blend, as described in Example 1. The physical properties of these bodies were as follows:

Density: 13.88 g/cm$^3$

Magnetic saturation: 117 [4πσ]

Magnetic field strength (Hc): 99 [Oe]

Vickers hardness (HV30): 1530

Porosity: <A02 e.B C06

The binder concentration gradient for these cermets is illustrated in FIG. 17. In this case a solid solution carbide depleted zone was determined at a distance of between 5 and 10 micrometers (μm) from the original surface of the sintered cemented carbide bodies, while a zone free of free carbon was present at a depth between 150 and 300 micrometers (μm).

The sintered cemented carbide bodies in accordance with the invention can be provided with adherent coatings in a conventional manner (PVD, CVD).

Thus, in other words, in one possible embodiment, there can be determined: (a) the density—measured as grams per cubic centimeters (g/cm$^3$); (b) the magnetic saturation—measured as one tenth microtesla-cubic meters per kilogram (0.1 μTm$^3$/kg); (c) the coercive force Hc or magnetic field strength—measured as oersteds (Oe), with the coercive force being measured substantially according to International Standard ISO 3326: Hardmetals—Determination of (the magnetization) coercivity); (d) the hardness—measured as $Hv_{30}$ by the Vickers hardness test, with the hardness being measured substantially according to International Standard ISO 3878: Hardmetals—Vickers hardness test; (e) the transverse rupture strength—measured as megapascals (MPa), with the transverse rupture strength being measured substantially according to International Standard ISO 3327/Type B: Hardmetals—Determination of transverse rupture strength); and (f) the porosity—measured substantially according to International Standard ISO 4505: Hardmetals—Metallographic determination of porosity and uncombined carbon.

With respect to the preparation the following may possibly apply, a binder of the cermet of the present invention may suitably comprise any material that forms or assists in forming a highly plastic structure, preferably having a fcc crystal structure, that is substantially stable even when subjected to high stresses and/or strains. It will be appreciated by those skilled in the art that a binder comprising cobalt, nickel, and iron may also comprise at least one other alloying element either in place of one or both of nickel and iron and/or in solution with the binder comprising cobalt, nickel, and iron and/or as discrete precipitates in the binder comprising cobalt, nickel, and iron. Such at least one other alloying element may contribute the physical and/or mechanical properties of the cermet. Whether or not the at least one other alloying element contributes to the properties of the cermet, the least one other alloying element may be included in the binder comprising cobalt, nickel, and iron to the extent that the least one other alloying element does not detract from the properties and/or performance of the cermet.

For example, an at least one other alloying element may comprise an alloying element or group of alloying elements that either stabilize and/or advance the formation of a fcc crystal structure that is stable even when subjected to high stresses and/or strains. For a cobalt containing binder, such an at least one other alloying element may comprise one or more of aluminum, boron, copper, titanium, zirconium, carbon, tin, niobium, manganese, platinum, palladium, and vanadium. Preferably, such an at least one other alloying element may comprise one or more metals such as copper, niobium, platinum, and palladium.

It will be appreciated by those skilled in the art that the possible binder content of the cermets of the present invention is dependent on such factors as the composition and/or geometry of the hard component, the use of the cermet, and the composition of the binder. For example, Applicants believe that when the inventive cermet comprises a tungsten-carbide cermet (WC-cermet) having a binder comprising cobalt, nickel, and iron, the binder content may comprise about four weight percent to about ten weight percent), and when the inventive cermet comprises a TiCN-cermet having a binder comprising cobalt, nickel, and iron, the binder content may comprise about four weight percent to about ten weight percent. As a further example, Applicants believe that when an inventive WC-cermet having a binder comprising cobalt, nickel, and iron is used as a pick-style tool for mining and construction, the binder content may comprise about four weight percent to about ten weight percent; and when an inventive WC-cermet having a binder comprising cobalt, nickel, and iron is used as a rotary tool for mining and construction, the binder content may comprise about four weight percent to about ten weight percent; and when an inventive WC-cermet having a binder comprising cobalt, nickel, and iron is used as a screw head punch, the binder content may comprise about four weight percent to about ten weight percent; and when an inventive cermet having a binder comprising cobalt, nickel, and iron is used as a cutting tool for chip forming machining of workpiece materials, the binder content may comprise about four weight percent to about ten weight percent; and when an inventive cermet having a binder comprising cobalt, nickel, and iron is used as an elongate rotary tool for machining materials, the binder content may comprise about four weight percent to about 10 weight percent.

A hard component may comprise at least one of borides, carbides, nitrides, oxides, silicides, their mixtures, their solid solutions or combinations of the proceedings. The metal of the at least one of borides, carbides, nitrides, oxides, or silicides may include one or more metals from international union of pure and applied chemistry (IUPAC) groups 2, 3, (including lanthanides, actinides), 4, 5, 6, 7, 8, 9, 10, 11, 12, 13, and 14. Preferably, the at least one hard component may comprise carbides, nitrides, carbonitrides, their mixtures, their solid solutions, or any combinations of the preceding. The metal of the carbides, nitrides, and carbonitrides may comprise one or more metals of IUPAC groups 3, including lanthanides and actinides, 4, 5, and 6; and more preferably, one or more of titanium, zirconium, hafnium, vanadium, niobium, tantalum, chromium, molybdenum, and tungsten.

In this context, inventive cermets may be referred to by the composition making up a majority of the hard component. For example, if a majority of the hard component comprises a carbide, the cermet may be designated a carbide-cermet. If a majority of the hard component comprises tungsten carbide (WC), the cermet may be designated a tungsten carbide cermet or WC-cermet. In a like manner, cermets may be called, for example, boride-cermets, nitride-cermets, oxide-cermets, silicide-cermets, carbonitride-cermets, oxynitride-cermets. For example, if a majority of the hard components comprise titanium carbonitride (TiCN), the cermet may be designated a titanium carbonitride cermet or TiCN-cermet. This nomenclature should not be limited by the above examples and instead forms a basis that bring a common understanding to those skilled in the art.

Dimensionally, the grain size of the hard component of the cermet having a high plasticity binder may possibly range in size from submicron to about 100 micrometers ($\mu$m) or greater. Submicrometer includes nanostructured materials having structural features ranging from about 1 nanometer to about 100 nanometers (0.1 $\mu$m) or more. It will be appreciated by those skilled in the art that the grain size of the hard component of the cermets of the present invention is dependent on such factors as the composition and/or geometry of the hard component, the use of the cermet, and the composition of the binder. For example, Applicants believe that when the inventive cermet, in accordance with one possible embodiment of the invention, comprises a WC-cermet having a binder comprising cobalt, nickel, and iron, the grain size of the hard component may possibly comprise about 0.1 micrometers ($\mu$m) to about 40 micrometers ($\mu$m), and when the inventive cermet, in accordance with one possible embodiment, comprises a TiCN-cermet having a binder comprising cobalt, nickel, and iron, the grain size of the hard component may possibly comprise about 0.5 micrometers ($\mu$m) to about 6 micrometers ($\mu$m). As a further example, Applicants believe that when an inventive WC-cermet having a binder comprising cobalt, nickel, and iron, in accordance with one possible embodiment, is used as a pick-style tool or a rotary tool for mining and construction, the grain size of the hard component may possibly comprise about 1 micrometer ($\mu$m) to about 30 micrometers ($\mu$m), preferably about 1 micrometer ($\mu$m) to about 25 micrometers ($\mu$m); and when an inventive WC-cermet having a binder comprising cobalt, nickel, and iron is used as a screw head punch, the grain size of the hard component may possibly comprise about 1 micrometer ($\mu$m) to about 25 micrometers ($\mu$m), preferably about 1 micrometer ($\mu$m) to about 15 micrometers ($\mu$m); and when an inventive cermet having a binder comprising cobalt, nickel, and iron is used as a cutting tool for chip forming machining of workpiece materials, in accordance with one possible embodiment of the invention, the grain size of the hard component may possibly comprise about 0.1 micrometers ($\mu$m) to 40 micrometers $\mu$m, preferably about 0.5 micrometers ($\mu$m) to 10 micrometers ($\mu$m); and when an inventive cermet having a binder comprising cobalt, nickel, and iron is used as an elongate rotary tool for machining materials, in accordance with one possible embodiment, the grain size of the hard component may possibly comprise about 0.1 micrometers ($\mu$m) to 12 micrometers ($\mu$m), preferably about 8 micrometers ($\mu$m) and smaller).

A cermet of the present invention may be used either with or without a coating depending upon the cermets use. If the cermet is to be used with a coating, then the cermet is coated with a coating that exhibits suitable properties such as, for example, lubricity, wear resistance, satisfactory adherence to the cermet, chemical inertness with workpiece materials at use temperatures, and a coefficient of thermal expansion that is compatible with that of the cermet (i.e., compatible thermo-physical properties). The coating may be applied via CVD and/or PVD techniques.

Examples of the coating material, which may comprise one or more layers of one or more different components, may be selected from the following, which is not intended to be all-inclusive: alumina, zirconia, aluminum oxynitride, silicon oxynitride, SiAlON, the borides of the elements from IUPAC groups 4, 5, and 6, the carbonitrides of the elements from IUPAC groups 4, 5, and 6, including titanium carbonitride, the nitrides of the elements from IUPAC groups 4, 5, and 6 including titanium nitride, the carbides of the elements from IUPAC groups 4, 5, and 6 including titanium carbide, cubic boron nitride, silicon nitride, carbon nitride, aluminum nitride, diamond, diamond like carbon, and titanium aluminum nitride.

The cermets of the present invention may possibly be made from a powder blend comprising a powder hard component and a powder binder that may possibly be consolidated by any forming means including, for example, pressing, for example, uniaxial, biaxial, triaxial, hydrostatic, or wet bag, e.g., isostatic pressing—either at room temperature or at elevated temperature, e.g., hot pressing, hot isostatic pressing, pouring; injection molding; extrusion; tape casting; slurry casting; slip casting; or and any combination of the preceding. Some of these methods are discussed in U.S. Pat Nos. 4,491,559; 4,249,955; 3,888,662; and 3,850,368, the subject matter of which is herein incorporated by reference in its entirety in the present application.

In any case, whether or not a powder blend is consolidated, its solid geometry may include any conceivable by a person skilled in the art. To achieve a shape or combinations of shapes, a powder blend may be formed prior to, during, and/or after densification. Prior densification forming techniques may include any of the above mentioned means as well as green machining or plastic forming the green body or their combinations. Post densification forming techniques may include any machining operations such as grinding, electron discharge machining, brush honing, cutting, and the like procedures.

A green body comprising a powder blend may then possibly be densified by any means that is compatible with making a cermet of the present invention. A preferred means comprises liquid phase sintering. Such means include vacuum sintering, pressure sintering (also known as sinter-HIP), hot isostatic pressing (HIPping), etc. These means are performed at a temperature and/or pressure sufficient to produce a substantially theoretically dense article having minimal porosity. For example, for WC-cermet having a binder comprising cobalt, nickel, and iron, such temperatures may possibly include temperatures ranging from about 1300 degrees Celsius (2373 degrees Fahrenheit) to about 1760 degrees Celsius (3200 degrees Fahrenheit) and preferably, from about 1400 degrees Celsius (2552 degrees Fahrenheit) to about 1600 degrees Celsius (2912 degrees Fahrenheit). Densification pressures may range from about zero kilopascals (kPa) (zero pounds per square inch (psi)) to about 206 megapascals (MPa) (30 kilopounds per square inch (ksi)). For carbide-cermet, pressure sintering (as so known as sinter-HIP) may be performed at from about 1.7 megapascals (MPa) (250 pounds per square inch (psi)) to about 13.8 megapascals (MPa) (2 kilopounds per square inch (ksi)) at temperatures from about 1370 degrees Celsius (2498 degrees Fahrenheit) to about 1600 degrees Celsius (2912 degrees Fahrenheit), while HIPping may be performed at from about 68 megapascals (MPa) (10 kilopounds per square inch (ksi) to about 206 megapascals (MPa) (30 kilopounds per square inch (ksi)) at temperatures from about 1,310 degrees Celsius (2373 degrees Fahrenheit) to about 1760 degrees Celsius (3200 degrees Fahrenheit).

Densification may be done in the absence of an atmosphere, i.e., vacuum; or in an inert atmosphere, e.g., one or more gasses of IUPAC group 18; in carburizing atmospheres; in nitrogenous atmospheres, e.g., nitrogen, forming gas (96 percent nitrogen, 4 percent hydrogen), ammonia, etc.; or in a reducing gas mixture, e.g., hydrogen/steam ($H_2/H_2O$), carbon monoxide/carbon dioxide ($CO/CO_2$), carbon monoxide/hydrogen/carbon dioxide/steam ($CO/H_2/CO_2/H_2O$), etc.; or any combination of the preceding. Thus, with respect to ranges, these are to be understood to include, within the range, steps such that any step may be a limit of a diminished range.

With respect to ranges mentioned, Applicants contemplate that every increment between the endpoints of ranges disclosed herein, for example, binder content, binder composition, Ni:Fe ratio, hard component grain size, hard component content, etc. is encompassed herein as if it were specifically stated.

For example, with respect to a binder content range of about 4 weight percent to about 10 weight percent, this is to be understood to includes within the range of weight percent, steps of weight percent in at least one weight percent, or smaller, such that any one weight percent may be a limit of a diminished range of weight percent, that is, the range encompasses about 1 weight percent increments thereby specifically including about 4 weight percent, 5 weight percent, 6 weight percent, 7 weight percent, 8 weight percent, 9 weight percent, and 10 weight percent.

For example, with respect to binder composition range of cobalt of about 40 weight percent to about 90 weight percent, this is to be understood to include, within the range of weight percent, steps of weight percent in at least one weight percent, or smaller, such that any one weight percent may be a limit of a diminished range of weight percent, that is, the range encompasses about 1 weight percent increments thereby specifically including 40 weight percent, 41 weight percent, 42 weight percent, 43 weight percent, 44 weight percent, and so forth to 87 weight percent, 88 weight percent, 89 weight percent, and 90 weight percent; while the nickel and iron content ranges of about 4 weight percent to 36 weight percent each encompass about 1 weight percent increments, or smaller thereby specifically including 4 weight percent, 5 weight percent, 6 weight percent, and so forth to 34 weight percent, 35 weight percent, and 36 weight percent.

Further for example, a Ni:Fe ratio range of about 1.5:1 to 1:1.5 encompasses about 0.1 increments, or smaller thereby specifically including 1.5:1, 1.4:1, 1.3:1, 1.2:1, and 1:1; and 1:1, 1:1.1, 1::1.2, 1:1.3, 1:1.4, and 1:1.5).

Furthermore for example, a hard component grain size range of about 0.1 micrometer ($\mu$m) to about 40 micrometers ($\mu$m) encompasses about 0.1 ($\mu$m) increments, or smaller, thereby specifically including about 0.1 micrometer ($\mu$m), 0.2 micrometer ($\mu$m), 0.3 micrometer ($\mu$m), 0.4 micrometer ($\mu$m), 0.5 micrometer ($\mu$m), 0.6 micrometer ($\mu$m), 0.7 micrometer ($\mu$m) 0.8 micrometer ($\mu$m), 0.9 micrometer ($\mu$m), 1.0 micrometer ($\mu$m), 1.1 micrometer ($\mu$m), 1.2 micrometer ($\mu$m), and so forth to 39.0 micrometer ($\mu$m), and so forth to 39.7 micrometer ($\mu$m), 39.8 micrometer ($\mu$m), 39.9 micrometer ($\mu$m) and 40 micrometer ($\mu$m).

The binder concentration of the cermet may have a gradient that is variously configured.

Thus, in one possible embodiment of the invention, the binder gradient or concentration gradient from the first, greater, concentration in the first portion at the exterior of the body to the second, lower, concentration near the interior of the body may possibly progress in a linear manner, that is, progressing in a straight line.

The gradient may in one embodiment of the invention comprise a staged behavior, that is, it may possibly not be progressing in a linear manner or following a straight line between the first concentration at the exterior to the second concentration at the interior of the body.

Thus, the binder gradient or concentration may comprise any possible behavior between the first concentration in the first portion at the exterior of the body and the second concentration at the second portion at the interior of the body, or at other possible locations, for example, a step-wise behavior, that is, an increasing ramp or slope behavior or gradient together with stages of uniform or constant behavior or concentration.

As well, in one possible embodiment of the invention the gradient may follow some possible curve, and may comprise discontinuities of gradient behavior, that is localized gradient behavior with portions having a diminished gradient or concentration, at various locations or portions.

It will be noted, however, that in any binder behavior the concentration of the binder components among one another remains substantially constant.

In an embodiment of this invention, the articles of the invention may possibly be used for materials manipulation or removal including, for example, mining, construction, agricultural, and machining applications. Some examples of agricultural applications include seed boots, see e.g., U.S. Pat. No. 5,325,799, inserts for agricultural tools, see e.g., U.S. Pat. Nos. 5,314,029 and 5,310,009, disc blades, see e.g., U.S. Pat. No. 5,297,634, stump cutters or grinders, see e.g., U.S. Pat. Nos. 5,005,622; 4,998,574; and 4,214,617, furrowing tools, see e.g., U.S. Pat Nos. 4,360,068 and 4,216,832, and earth working tools, see e.g., U.S. Pat Nos. 4,859,543; 4,326,592; and 3,934,654. Some examples of mining and construction applications include cutting or digging tools, see e.g., U.S. Pat. Nos. 5,324,098; 5,261,499; 5,219,209; 5,141,289; 5,131,481; 5,112,411; 5,067,262; 4,981,328; and 4,316,636, earth augers, see e.g., U.S. Pat. Nos. 5,143,163 and 4,917,196, mineral or rock drills, see e.g., U.S. Pat Nos. 5,184,689; 5,172,775; 4,716,976; 4,603,751; 4,550,791; 4,549,615; 4,324,368; and 3,763,941, construction equipment blades, see e.g., U.S. Pat Nos. 4,770,253; 4,715,450; and 3,888,027, rolling cutters, see e.g., U.S. Pat. Nos. 3,804,425 and 3,734,213, earth working tools, see e.g., U.S. Pat. Nos. 4,859,543; 4,542,943; and 4,194,791, comminution machines, see e.g., U.S. Pat Nos. 4,177,956 and 3,995,782, excavation tools, see e.g., U.S. Pat Nos. 4,346,934; 4,069,880; and 3,558,671, and other mining or construction tools, see e.g., U.S. Pat. Nos. 5,226,489; 5,184,925; 5,131,724; 4,821,819; 4,817,743; 4,674,802; 4,371,210; 4,361,197; 4,335,794; 4,083,605; 4,005,906; and 3,797,592. Some examples of machining applications included materials cutting inserts, see e.g., U.S. Pat Nos. 4,946,319; 4,685,844; 4,610,931; 4,340,324; 4,318,643; 4,297,050; 4,259,033; and 2,201,979 (RE 30,908), materials cutting inserts incorporating chip control features, see e.g., U.S. Pat. Nos. 5,141,367; 5,122,017; 5,166,167; 50,032,050; 4,993,893; 4,963,060; 4,957,396; 4,854,784; and 4,834,592, and materials cutting inserts comprising coating applied by any of chemical vapor deposition (CVD), physical vapor deposition (PVD), conversion coating, etc. see e.g., U.S. Pat Nos. 5,325,747; 5,266,388; 5,250,367; 5,232,318; 5,188,489; 5,075,181; 4,984,940; and 4,610,931 (RE 34,180). The subject matter of all of the above patents relating to applications is incorporated by reference in the present application. Particularly, the articles may be used in wear applications where an article comprising, for example, a preselected geometry with a forward portion manipulates or removes materials (e.g., rock, wood, ore, coal, earth, road surfaces, synthetic materials, metals, alloys, composite materials (ceramic matrix composites (CMCs), metal matrix composites (MMCs), and polymer or plastic matrix composites (PMCs)), polymers, etc.). More particularly, the articles may be used in applications where it is desirable to maintain a working portion or a contacting portion or both of an article incorporated within a tool to extend the life of the tool.

One feature of the invention resides broadly in a sintered cemented carbide body, comprising at least one hard component and a binder comprising cobalt, nickel, and iron comprising about forty to ninety weight percent cobalt, the remainder of the binder consisting of nickel and iron, apart from incidental impurities, with nickel comprising at least four but no more than thirty-six weight percent of the binder and iron comprising at least four but no more than thirty-six weight percent of the binder, and the binder having a nickel-to-iron (Ni:Fe) ratio of about one point five to one to one to one point five, characterized in that the concentration of the binder comprising cobalt, nickel, and iron has a gradient within the cemented carbide body and that the binder comprising cobalt, nickel, and iron substantially has a face centered cubic structure and does not experience phase transformations induced by tension, strain or other stresses.

Another feature of the invention resides broadly in a sintered cemented carbide body characterized in that the concentration of the binder comprising cobalt, nickel, and iron has a gradient which increases from the interior of the cemented carbide body toward the surfaces thereof.

Yet another feature of the invention resides broadly in a sintered cemented carbide body characterized in that the binder comprising cobalt, nickel, and iron is enriched in a zone (BEZ) near the surface of the cemented carbide body.

Still another feature of the invention resides broadly in a sintered cemented carbide body characterized in that the enriched zone (BEZ) is located at a depth of up to about 40 micrometers ($\mu$m) as measured from the surface of the cemented carbide body.

A further feature of the invention resides broadly in a sintered cemented carbide body characterized in that the ratio of the constituents of the binder among each other cobalt-to-nickel-to-iron (Co:Ni:Fe) is the same within the enriched zone (BEZ) in the binder as that outside of the enriched zone (BEZ) in the binder.

Another feature of the invention resides broadly in a sintered cemented carbide body characterized in that the binder comprising cobalt, nickel, and iron is substantially austenitic. Yet another feature of the invention resides broadly in a sintered cemented carbide body characterized in that the proportion of the binder in the sintered cemented carbide amounts to four to ten weight percent.

Still another feature of the invention resides broadly in a sintered cemented carbide body characterized in that the at least one hard component is selected from the group consisting of carbides, nitrides, carbonitrides, their mixtures, and their solid solutions.

A further feature of the invention resides broadly in a sintered cemented carbide body characterized in that the at least one hard component comprises at least one carbide which is selected from the carbides of titanium, zirconium, hafnium, vanadium, niobium, tantalum, chromium, molybdenum, and/or tungsten.

Another feature of the invention resides broadly in a sintered cemented carbide body characterized in that the at least one hard component comprises at least one carbonitride which is selected from the carbonitrides of titanium, zirconium, hafnium, vanadium, niobium, tantalum, chromium, molybdenum, and/or tungsten.

Still another feature of the invention resides broadly in a use of a sintered cemented carbide body as a cutting insert, an indexable insert or for the production of cemented carbide tools and tool inserts.

Thus, in accordance with one aspect, the invention relates to a sintered cemented carbide body (cermet), comprising at least one hard component and a binder comprising cobalt, nickel, and iron (cobalt-nickel-iron-binder), comprising about forty to ninety weight percent cobalt, the remainder of the binder consisting of nickel and iron, apart from incidental impurities, with nickel comprising at least four but no more than thirty-six weight percent of the binder and iron comprising at least four but no more than thirty-six weight percent of the binder, and the binder having a nickel-to-iron (Ni:Fe) ratio of about one point five to one to one to one point five.

The following definitions may possibly be used in the understanding of the present invention.

In other words, cermet may be understood as a heterogeneous body composed of two or more intimately mixed but separable phases, of which at least one is ceramic and the other metallic, combining strength and toughness of metal with the thermal resistance of the ceramic; formed by mixing, pressing, and sintering; used in rocket motors, gas turbines, turbojet engines, nuclear reactors, brake linings, etc., and other products requiring high-oxidation resistance at elevated temperatures. Further in other words, the expression cermet, derived from ceramic" and metal, may possibly refer to a semisynthetic product consisting of a mixture of ceramic and metallic components having physical properties not found solely in either one alone, e.g., metal carbides, borides, oxides, and suicides. They combine the strength and toughness of the metal with the heat and oxidation resistance of the ceramic material. The composition may range from predominantly metallic to predominantly ceramic, e.g., SAP sintered aluminum powder contains 85 percent aluminum and 15 percent aluminum oxide, corundum, ($Al_2O_3$). The most important industrial cermets are titanium carbide-based, aluminum oxide-based, and special uranium dioxide types. Cermets are made by powder metallurgy techniques involving use of bonding agents such as tantalum, titanium, and zirconium. They exhibit high stress-to-rupture rates, and operate continuously at 982 degrees Celsius, for short periods at 2200 degrees Celsius. Use thereof is, inter alia, in gas turbines, rocket motor parts, turbojet engine components, nuclear fuel elements, coatings for high-temperature resistance applications, sensing elements in instruments, seals, bearings, etc., in special pumps, and in other equipment.

Further in other words, cermet is a term used to possibly describe a monolithic material composed of a hard component and a binder component. The hard component comprises a nonmetallic compound or a metalloid. The hard component may or may not be interconnected in two or three dimensions. The binder component comprises a metal or alloy and is generally interconnected in three dimensions. The binder component cements the hard component together to form the monolithic material. Each monolithic cermet's properties are derived from the interplay of the characteristics of the hard component and the characteristics of the binder component. For example, if the hard component or the binder component exhibits ferromagnetic characteristics so might the monolithic cermet.

A cermet family may be defined as a monolithic cermet consisting of a specified hard component combined with a specified binder component. Tungsten carbide cemented together by a cobalt alloy is an example of a family (WC-Co family, a cemented carbide). The properties of a cermet family may be tailored, for example, by adjusting an amount, a characteristic feature, or an amount and a characteristic feature of each component separately or together. However, an improvement of one material property invariably decreases another. When, for example, in the WC-Co family as resistance to wear is improved, the resistance to breakage generally decreases. Thus, in the design of monolithic cemented carbides there is a never ending cycle that includes the improvement of one material property at the expense of another.

Despite this, monolithic cemented carbides are used in equipment subject to aggressive wear, impact, or both. However, rather than build the entire equipment from monolithic cemented carbides, only selected portions of the equipment comprise the monolithic cemented carbide. These portions experience the aggressive wear, impact, or both. In some equipment the cemented carbide portion has a specified profile that should be sustained to maintain the maximum efficiency of the equipment. As the specified profile changes, the equipment's efficiency decreases. If the equipment is used for cutting a work piece, the amount removed from the work piece decreases as the profile of the cemented carbide deviates from the specified profile.

Whenever used herein, the term "cermet" refers to those materials, only, which comprise at least one metallic phase and at least one ceramic phase such as tungsten carbide (WC). Diamond and graphite per se are not considered to be "ceramic" in the language of the present application. Thus, materials comprising diamond or graphite embedded in a metal matrix or bonded with a metal alloy do not form a "cermet" in the sense of the present invention.

Austenitic may possibly refer to solid solution of one or more elements in face-centered cubic elemental configuration with the solute generally being assumed to be carbon.

Face centered cubic may possibly be one of the two close-packed structures, that is, the spheres in a possible third layer could lie over the gaps in a possible first layer that were not covered by a possible second layer.

Oersted (Oe) refers to the unit of magnetic field strength in the c.g.s. electromagnetic system, that is, a field has a strength of one oersted if it exerts a force of one dyne on a unit magnetic pole placed on it.

The term conversion coating may possibly refer to the replacement of native oxide on the surface of a metal by the controlled chemical formation of a film. Oxides or phosphates are common conversion coatings. Conversion coatings are used on metals such as aluminium, iron, zinc, cadmium or magnesium and their alloys, and provide a key for paint adhesion and/or corrosion protection of the substrate metal.

Sintering, according to ISO, the International Standards Organization, possibly refers to the thermal treatment of a powder or compact at a temperature below the melting point of the main constituent, for the purpose of increasing its strength by bonding together of the particles.

A burr may comprise a small rotary tool.

A hob comprises a tool to cut gear teeth.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications, or patent publications, which were cited in the Search Report of the German Patent Office dated Oct. 5, 1999 and relating to Federal Republic of Germany patent application 199 07 749.5, and the PCT Search Report dated May 17, 2000 and relating to International patent application PCT/IB00/00157, are hereby incorporated by reference as if set forth in their entirety herein as follows: from the search report of the German Patent Office: DE 32 11 047 C2; EP 0629 713 A2; WO 96 20 058; WO 93 17 140; and GREWE, H., et al., "Cobalt-substitution in technischen Hartmetallen [Cobalt substitution in engineering hardmetals," in METALL, volume 40, issue 2, February 1986, pages 133 to 140, particularly page 134, center column, in the table lines 2 and 3; and from the PCT Search Report: DATABASE WPI, Section Ch, Week 199907, Derwent Publications Ltd., London, GB, Class L02, AN 1999-081741, XP002137031—& ZA 9 807 573 A (KENNAMETAL INC.), corresponding to U.S. Pat. No. 6,024,776; EP 0 247 985 A (SANTRADE LTD), Dec. 2 1987 (1987-12-02), corresponding to U.S. Pat. No. 4,820, 482; EP 0 603 143 A (SANDVIK AB) Jun. 22, 1994 (1994-06-22); B UHRENIUS ET AL: "On the composition of Fe—Ni—Co-WC-based cemented carbides," INTERNATIONAL JOURNAL OF REFRACTORY METALS AND HARD MATERIALS, GB. ELSEVIER PUBLISHERS, BARKING, vol. 15, Jan. 1, 1997 (1997-01-01), pages 139–149, XP002085833, ISSN: 0263-4368; GREWE ET AL: "Substitution of cobalt in cemented carbides" METALL, DE, HEIDELBERG, vol. 40, no. 2, Feb. 1, 1986 (1986-02-01), pages 133–140, XP002086162, Page 134, compositions 2 and 3; Page 135, 2.1.1; GUILE MANY ET AL: "Mechanical-property relationships of Co/WC and Co—Ni—Fe/WC hard metal alloys" STM CALLUS, H, XX, vol. 22, no. 121, Nov. 28, 1994 (1994-11-28). XP002085834.

The corresponding foreign and international patent publication applications, namely, Federal Republic of Germany patent application No. 199 07 749.5, filed on Feb. 23, 1999, having inventors Dr. Hans-Will HEINRICH, Manfred WOLF, and Dieter SCHMIDT, and DE-OS 199 07 749.5, having inventors Dr. Hans-Will HEINRICH, Manfred WOLF, and Dieter SCHMIDT, and DE-PS 199 07 749.5, having inventors Dr. Hans-Will HEINRICH, Manfred WOLF, and Dieter SCHMIDT, and International Application No. PCT/IB00/00157, filed on Feb. 14, 2000, having inventors Dr. Hans-Will HEINRICH, Manfred WOLF, and Dieter SCHMIDT, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The following U.S. Patent relating to drilling tools and the like, are hereby incorporated by reference as if set forth in their entirety herein: U.S. Pat. No. 5,967,710 to Krenzer [Attorney Docket No. NHL-KEH-02]; No. 5,873,683 to Krenzer [Attorney Docket No.: NHL-KEH01; No. 5,829, 926 to Kammermeier [Attorney Docket No. [NHL-KEH-06].

The following pending U.S. patent applications are hereby incorporated as if set forth in their entirety herein: Ser. No.: 09/516,873, having Attorney Docket No. NHL-KEH 11 US, filed on Mar. 2, 2000, having inventors Rudi HARTLÖ HNER and Hermann PROKOP and entitled, "Thread cutting bit," Ser. No. 09/471,768, having Attorney Docket No. NHL-KEH-12 US, filed on Dec. 23, 1999, having inventor Bernhard BORSCHERT and entitled, "Twist drill for dry drilling," Ser. No. 09/521,134 having Attorney Docket No. NHL-KEH-13 US, filed on Mar. 8, 2000, having inventor Gebhard MULLER and Horst JAGER and entitled, "Disk milling cutter and suitable indexable insert."

All of the references and documents, cited in any of the documents cited herein, and the references they are in turn cited in, are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

Some examples of cermets and preparation and composition thereof, features of which may possibly be used or adapted for use in a possible embodiment of the present invention may be found in the following U.S. Pat. No. 5,603,071 issued to Kitagawa et al. on Feb. 11, 1997 and entitled, "Method of preparing cemented carbide or cermet alloy," U.S. Pat. No. 5,658,678 issued to Stoll et al. on Aug. 19, 1997 and entitled, "Corrosion resistant cermet wear parts," U.S. Pat. No. 5,710,383 issued to Takaoka on Jan. 20, 1998 and entitled, "Carbonitride-type cermet cutting tool having excellent wear resistance," U.S. Pat. No. 5,766,742 issued to Nakamura et al. on Jun. 16, 1998 and entitled, "Cutting blade of titanium carbonitride-base cermet, and cutting blade made of coated cermet," U.S. Pat. No. 5,796, 019 issued to Lupton et al. on Aug. 18, 1998 and entitled, "Method of manufacturing an electrically conductive cermet," U.S. Pat. No. 5,802,955 issued to Stoll et al. on Sep. 8, 1998 and entitled, "Corrosion resistant cermet wear parts," U.S. Pat. No. 5,856,032 issued to Daub et al. on Jan. 5, 1999 and entitled, "Cermet and process for producing it," and U.S. Pat. No. 5,860,055 issued to Hesse et al. on Jan. 12, 1999 and entitled, "Process for producing granular material and shaped parts from hard metal materials or cermet materials." These U.S. patents are hereby incorporated as if set forth in their entirety herein.

Some further examples of cemented carbide tools, features of which may possibly used or adapted for use in an embodiment of the present invention may be found in the following U.S. Pat. Nos. 5,585,176; 5,632,941; 5,648,119; 5,651,295; and 5,716,170, all of these references are hereby incorporated by reference as if set forth in their entirety herein.

Some further examples of cutting insert, features of which may possibly be used or adapted for use in an embodiment of the present invention may be found in the following U.S. Pat. Nos. 6,161,990; 6,170,368; 6,190,096; 6,217,992; and 6,238,133, all of these references are hereby incorporated by reference as if set forth in their entirety herein.

Some further examples of tool inserts, features of which may possibly be used or adapted for use in a possible embodiment of the present invention may be found in the following U.S. Pat. Nos. 5,772,365; 5,829,924; 5,921,724; 6,217,992; and Re 37,149, all of these references are hereby incorporated by reference as if set forth in their entirety herein.

Some further examples of indexable inserts, features of which may possibly be used or adapted for use in a possible embodiment of the present invention may be found in the following U.S. Pat. Nos. 3,996,651; 4,011,049; 4,063,841; 4,093,392; and 6,203,251, all of these references are hereby incorporated by reference as if set forth in their entirety herein.

Some further examples of cermets, that is, cemented carbides concerned with commercially important composites of pure refractory material and binder metal of high ductility, their preparation and use and related embodiments; as well as possibly with aspects of refractory hard metals, features of which may possibly be used or adapted for use in a possible embodiment of the present invention may be found in the following U.S. Pat. Nos. 4,011,049; 4,274,876; 4,417,922; 4,964,321; 4,985,070; 4,990,410; 5,059,491; 5,110,543; 5,145,505; 5,296,016; 5,306,326; 5,308,376; 5,330,553; 5,336,292; 5,395,421; 5,403,542; 5,429,199; 5,470,372; 5,541,006; 5,733,664; 5,753,163; 5,860,055; 5,977,529; 5,648,119; 5,694,639; 5,829,924; 5,976,213; 6,183,687; 6,197,083; 6,238,133; and 6,248,434, all of these patents are hereby incorporated by reference as if set forth in their entirety herein.

The details in the patents, patent applications and publications may be considered to be incorporable, at Applicants's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A twist drill having a central longitudinal axis, said twist drill comprising:

a cutting tip being configured to impact a material to be drilled to initiate drilling of the material;

a shank portion being configured to be inserted into and held in a chucking arrangement for a drill;

a fluted portion being disposed between and to connect said tip portion and said shank portion;

said fluted portion comprising:

a first chip flute and a second chip flute;

said first chip flute and said second chip flute being substantially symmetric with respect to one another and substantially helically disposed about said central longitudinal axis;

a first cutting edge being disposed between said cutting tip and said first chip flute;

a second cutting edge being disposed between said cutting tip and said second chip flute;

said first cutting edge and said second cutting edge being substantially symmetric with respect to one another about said central longitudinal axis;

said first chip flute being disposed to extend helically along said fluted portion from said first cutting edge;

said second chip flute being disposed to extend helically along said fluted portion from said second cutting edge;

at least a portion of said cutting tip and at least a portion of said fluted portion comprise a tool portion having an interior and an exterior; and said tool portion comprising:

a cermet body configured to engage material to remove or dislodge material;

said cermet body comprising at least one hard component and a binder;

said binder comprising:

cobalt in the range of from about forty weight percent to about ninety weight percent;

nickel in the range of from about four weight percent to about thirty-six weight percent; and iron in the range of from about four weight percent to about thirty-six weight percent;

said binder having a ratio of nickel to iron in the range of about 1.5:1 to about 1:1.5;

said binder in said body having a first concentration at a first portion and a second concentration at a second portion;

said first concentration in said first portion being substantially different from said second concentration in said second portion to thus form a gradient in said body;

said binder comprising a substantially face centered cubic structure, with the difference in concentration between said first concentration and said second concentration of said binder in said body being configured and disposed to substantially maintain said face centered cubic structure of said binder upon said binder being subjected to plastic deformation; and the difference in concentration between said first concentration and said second concentration of said binder in said body also being configured and disposed to minimize stress and strain induced transformations in said binder, and to maximize fatigue resistance and toughness in said body.

2. The twist drill according to claim 1, wherein:

said first concentration at said first portion comprises a concentration at said exterior of said tool portion greater than said second concentration at said second portion at said interior of said tool portion.

3. The twist drill according to claim 2, wherein:

said first concentration at said first portion is disposed at a depth of up to about forty micrometers as measured from said exterior of said tool portion.

4. The twist drill according to claim 3, wherein:

the ratio of said components of said binder is the same within said first portion and said second portion.

5. A tool having a material engaging and manipulating portion configured to remove or dislodge material, said tool comprising one of: a drill, an endmill, a reamer, a threading tool, a threading tap, a material cutting insert, a milling insert, an indexable insert, a material cutting insert with a chip control structure, a material milling insert with chip control structure, an earth auger, a mineral drill, a rock drill, a snow plow blade, a roller cutter, a grinding apparatus, a comminuting apparatus, a seed boot, a disc blade, a stump cutter, a grinder, a furrowing tool, a screw head punch; said tool comprising:

a cermet body configured to engage material to remove or dislodge material;

said cermet body comprising at least one hard component and a binder;

said binder comprising:

cobalt in the range of from about forty weight percent to about ninety weight percent;

nickel in the range of from about four weight percent to about thirty-six weight percent; and iron in the range of from about four weight percent to about thirty-six weight percent;

said binder having a ratio of nickel to iron in the range of about 1.5:1 to about 1:1.5;

said binder in said body having a first concentration at a first portion and a second concentration at a second portion;

said first concentration in said first portion being substantially different from said second concentration in said second portion to thus form a gradient in said body;

said binder comprising a substantially face centered cubic structure, with the difference in concentration between said first concentration and said second concentration of said binder in said body being configured and disposed to substantially maintain said face centered cubic structure of said binder upon said binder being subjected to plastic deformation; and the difference in concentration between said first concentration and said second concentration of said binder in said body also being configured and disposed to minimize stress and strain induced transformations in said binder, and to maximize fatigue resistance and toughness in said body.

6. The tool according to claim 5, wherein:

said first concentration at said first portion comprises a concentration at the exterior of said body greater than said second concentration at said second portion at the interior of said body.

7. The tool according to claim 6, wherein:

said first concentration at said first portion is disposed at a depth of up to about forty micrometers measured from the exterior of said body.

8. The tool according to claim 7, wherein:

the ratio of the components of said binder is the same within said first portion and in said second portion.

9. The tool according to claim 8, wherein:

said binder comprises an austenitic binder.

10. The tool according to claim 9, wherein:

said binder comprises from four weight percent to about ten weight percent of said body.

11. The tool according to claim 10, wherein said at least one hard component comprises at least one of (A.); (B.); and (C):

(A.) at least one carbide, at least one nitride, at least one carbonitride, their mixtures, and their solid solutions;

(B.) at least one carbide of titanium, at least one carbide of zirconium, at least one carbide of hafnium, at least one carbide of vanadium, at least one carbide of niobium, at least one carbide of tantalum, at least one carbide of chromium, at least one carbide of molybdenum, and at least one carbide of tungsten; and (C.) at least one carbonitride of titanium, at least one carbonitride of zirconium, at least one carbonitride of hafnium, at least one carbonitride of vanadium, at least one carbonitride of niobium, at least one carbonitride of tantalum, at least one carbonitride of chromium, at least one carbonitride.

12. The tool according to claim 11, wherein:

said tool comprises a rotary tool comprising:

an elongate tool body having an axially forward end and an axially rearward end;

a hard insert affixed to said tool body at the axially forward end thereof;

said hard insert comprising said cermet body.

13. The tool according to claim 11, wherein:

said tool comprises a cutting tool for chip forming machining of workpiece materials, said cutting tool comprising:

a rake face, over which rake face flow chips formed during the chip forming machining of workpiece materials;

a flank face; and a cutting edge for cutting into the workpiece materials to form the chips, said cutting edge being formed at a junction of said rake face and said flank face; and wherein at least a portion of said rake face, a portion of said flank face and a portion of said cutting edge of the cutting tool comprise said cermet body.

14. The tool according to claim 11, wherein:

said tool comprises an elongate rotary tool for machining materials, said rotary tool comprising:

an elongate body at a first end;

a shank at a second and opposite end;

said elongate body and said shank are disposed to share a common axis;

at least one face on said elongate body at an end opposite said shank, wherein said at least one face defines a corresponding flute extending along said elongate body toward said shank;

at least one flank on an end of said elongate body at an end opposite said shank; and a cutting edge at a juncture of said at least one face and said at least one flank; and wherein said at least one flank, said at least one face, and said cutting edge at the juncture thereof of said elongate rotary tool comprise said cermet body.

15. The tool according to claim 11, wherein:

said tool comprises a pick-style tool comprising:

an elongate tool body having an axially forward end and an axially rearward end;

a hard insert affixed to said tool body at the axially forward end thereof; and said hard insert comprising said cermet body.

16. A tool comprising one of: a drill, an endmill, a reamer, a threading tool, a threading tap, a material cutting insert, a milling insert, an indexable insert, a material cutting insert with a chip control structure, a material milling insert with chip control structure, an earth auger, a mineral drill, a rock drill, a snow plow blade, a roller cutter, a grinding apparatus, a comminuting apparatus, a seed boot, a disc blade, a stump cutter, a grinder, a furrowing tool, a screw head punch, an endmill, a tap, a burr, a countersink, a hob, and a reamer; said tool comprising:

a cermet body;

said cermet body comprising at least one hard component and a binder;

said binder comprising:

cobalt in the range of from about forty weight percent to about ninety weight percent;

nickel in the range of from about four weight percent to about thirty-six weight percent; and iron in the range of from about four weight percent to about thirty-six weight percent;

said binder having a ratio of nickel to iron in the range of about 1.5:1 to about 1:1.5;

said binder in said body having a first concentration at a first portion and a second concentration at a second portion;

said first concentration in said first portion being substantially different from said second concentration in said second portion to thus form a gradient in said body;

said binder comprising a substantially face centered cubic structure, with the difference in concentration between said first concentration and said second concentration of said binder in said body being configured and disposed to substantially maintain said face centered cubic structure of said binder upon said binder being subjected to deformation; and the difference in concentration between said first concentration and said second concentration of said binder in said body also being configured and disposed to minimize stress and strain induced transformations in said binder.

17. The tool according to claim 16, wherein said binder consists essentially of:

cobalt in the range of from about forty weight percent to about ninety weight percent;

nickel in the range of from about four weight percent to about thirty-six weight percent;

iron in the range of from about four weight percent to about thirty-six weight percent; and impurities consisting of materials other than cobalt, nickel, and iron.

18. The tool according to claim 17, wherein:

said first concentration at said first portion comprises a concentration at the exterior of said body greater than said second concentration at said second portion at the interior of said body.

19. The tool according to claim 18, wherein:

said first concentration at said first portion is disposed at a depth of up to about forty micrometers measured from the exterior of said body.

20. The tool according to claim 19, wherein:

the ratio of the components of said binder is the same within said first portion and in said second portion.

21. The tool according to claim 20, wherein:

said binder comprises an austenitic binder.

22. The tool according to claim 21, wherein:

said binder comprises from four weight percent to about ten weight percent of said body.

23. The tool according to claim 22, wherein said at least one hard component comprises at least one of (A.); (B.); and (C):

(A.) at least one carbide, at least one nitride, at least one carbonitride, their mixtures, and their solid solutions;

(B.) at least one carbide of titanium, at least one carbide of zirconium, at least one carbide of hafnium, at least one carbide of vanadium, at least one carbide of niobium, at least one carbide of tantalum, at least one carbide of chromium, at least one carbide of molybdenum, and at least one carbide of tungsten; and (C.) at least one carbonitride of titanium, at least one carbonitride of zirconium, at least one carbonitride of hafnium, at least one carbonitride of vanadium, at least one carbonitride of niobium, at least one carbonitride of tantalum, at least one carbonitride of chromium, at least one carbonitride.

* * * * *